US008066055B2

(12) United States Patent
Kroliczek et al.

(10) Patent No.: US 8,066,055 B2
(45) Date of Patent: Nov. 29, 2011

(54) THERMAL MANAGEMENT SYSTEMS

(75) Inventors: Edward J. Kroliczek, Davidsonville, MD (US); James S. Yun, Beltsville, MD (US); David C. Bugby, Beltsville, MD (US); David A. Wolf, Sr., Baltimore, MD (US)

(73) Assignee: Alliant Techsystems Inc., Minneapolis, MN (US)

( * ) Notice: Subject to any disclaimer, the term of this patent is extended or adjusted under 35 U.S.C. 154(b) by 182 days.

(21) Appl. No.: 12/426,001

(22) Filed: Apr. 17, 2009

(65) Prior Publication Data

US 2009/0200006 A1 Aug. 13, 2009

Related U.S. Application Data

(63) Continuation of application No. 10/890,382, filed on Jul. 14, 2004, now Pat. No. 7,549,461, and a continuation-in-part of application No. 10/602,022, filed on Jun. 24, 2003, now Pat. No. 7,004,240, and a continuation-in-part of application No. 09/896,561, filed on Jun. 29, 2001, now Pat. No. 6,889,754.

(60) Provisional application No. 60/486,467, filed on Jul. 14, 2003, provisional application No. 60/391,006, filed on Jun. 24, 2002, provisional application No. 60/215,588, filed on Jun. 30, 2000.

(51) Int. Cl.
*F28D 15/00* (2006.01)
*F28F 27/00* (2006.01)

(52) U.S. Cl. .. 165/11.1; 165/272; 165/274; 165/104.21; 165/104.26

(58) Field of Classification Search ..... 165/11.1, 165/272, 273, 274, 104.21, 104.26, 104.33; 62/59

See application file for complete search history.

(56) References Cited

U.S. PATENT DOCUMENTS 3,490,718 A 1/1970 Vary (Continued)

FOREIGN PATENT DOCUMENTS

DE 19941398 8/2000

(Continued)

OTHER PUBLICATIONS

European Search Report (Application No. EP 04 01 6584) dated May 15, 2006 (4 total pages).

(Continued)

*Primary Examiner* — Ljiljana Ciric
(74) *Attorney, Agent, or Firm* — TraskBritt

(57) ABSTRACT

A system including a primary evaporator facilitating heat transfer by evaporating liquid to obtain vapor is disclosed. The primary evaporator receives a liquid from a liquid line and outputs the vapor to a vapor line. The primary evaporator also outputs excess liquid received from the liquid line to an excess fluid line. A condensing system receives the vapor from the vapor line, and outputs the liquid and excess liquid to the liquid line. The excess liquid is obtained at least partially from a reservoir. A primary loop includes the condensing system, the primary evaporator, the liquid line, and the vapor line, and provides a heat transfer path. Similarly, a secondary loop includes the condensing system, the primary evaporator, the liquid line, the vapor line, and the excess fluid line. The secondary loop provides a venting path for removing undesired vapor within the liquid or excess liquid from the primary evaporator.

40 Claims, 25 Drawing Sheets

U.S. PATENT DOCUMENTS

| | | | | |
|---|---|---|---|---|
| 3,613,778 | A | 10/1971 | Feldman, Jr. | |
| 3,661,202 | A | 5/1972 | Moore, Jr. | |
| 3,677,336 | A | 7/1972 | Moore, Jr. | |
| 3,734,173 | A | 5/1973 | Moritz | |
| 3,756,903 | A | 9/1973 | Jones | |
| 3,792,318 | A | 2/1974 | Fries et al. | |
| 3,803,688 | A | 4/1974 | Peck | |
| 3,884,293 | A | 5/1975 | Pessolano et al. | |
| 4,005,297 | A | 1/1977 | Cleaveland | |
| 4,046,190 | A | 9/1977 | Marcus et al. | |
| 4,087,893 | A | 5/1978 | Sata et al. | |
| 4,116,266 | A | 9/1978 | Sawata et al. | |
| 4,170,262 | A | 10/1979 | Marcus et al. | |
| 4,467,861 | A | 8/1984 | Kiseev et al. | |
| 4,470,450 | A | 9/1984 | Bizzell et al. | |
| 4,470,451 | A | 9/1984 | Alario et al. | |
| 4,503,483 | A | 3/1985 | Basiulis | |
| 4,685,512 | A | 8/1987 | Edelstein et al. | |
| 4,770,238 | A | 9/1988 | Owen | |
| 4,819,719 | A | 4/1989 | Grote et al. | |
| 4,830,718 | A | 5/1989 | Stauffer | |
| 4,854,379 | A | 8/1989 | Shaubach et al. | |
| 4,862,708 | A | 9/1989 | Basiulis | |
| 4,869,313 | A | 9/1989 | Fredley | |
| 4,883,116 | A | 11/1989 | Seidenberg et al. | |
| 4,890,668 | A | 1/1990 | Cima | |
| 4,898,231 | A | 2/1990 | Miyazaki | |
| 4,899,810 | A | 2/1990 | Fredley | |
| 4,934,160 | A | 6/1990 | Mueller | |
| 5,002,122 | A | 3/1991 | Sarraf et al. | |
| 5,016,705 | A | 5/1991 | Bahrle | |
| 5,103,897 | A | 4/1992 | Cullimore et al. | |
| 5,303,768 | A | 4/1994 | Alario et al. | |
| 5,335,720 | A | 8/1994 | Ogushi et al. | |
| 5,642,776 | A | 7/1997 | Meyer, IV et al. | |
| 5,725,049 | A | 3/1998 | Swanson et al. | |
| 5,761,037 | A | 6/1998 | Anderson et al. | |
| 5,769,154 | A | 6/1998 | Adkins et al. | |
| 5,771,967 | A | 6/1998 | Hyman | |
| 5,816,313 | A | 10/1998 | Baker | |
| 5,842,513 | A | 12/1998 | Maciaszek et al. | |
| 5,899,265 | A | 5/1999 | Scheider et al. | |
| 5,944,092 | A | 8/1999 | Van Oost | |
| 5,947,193 | A | 9/1999 | Adkins et al. | |
| 5,950,710 | A | 9/1999 | Liu | |
| 5,966,957 | A | 10/1999 | Malhammar et al. | |
| 6,058,711 | A | 5/2000 | Maciaszek et al. | |
| 6,227,288 | B1 | 5/2001 | Gluck et al. | |
| 6,330,907 | B1 | 12/2001 | Ogushi et al. | |
| 6,381,135 | B1 | 4/2002 | Prasher et al. | |
| 6,382,309 | B1 | 5/2002 | Kroliczek et al. | |
| 6,415,627 | B1 | 7/2002 | Pfister et al. | |
| 6,450,132 | B1 | 9/2002 | Yao et al. | |
| 6,450,162 | B1 | 9/2002 | Wang et al. | |
| 6,533,029 | B1 | 3/2003 | Phillips | |
| 6,591,902 | B1 | 7/2003 | Trent | |
| 6,596,035 | B2 | 7/2003 | Gutkowski et al. | |
| 6,615,912 | B2 | 9/2003 | Garner | |
| 6,810,946 | B2 * | 11/2004 | Hoang | 165/104.26 |
| 6,840,304 | B1 | 1/2005 | Kobayashi et al. | |
| 6,889,754 | B2 * | 5/2005 | Kroliczek et al. | 165/104.26 |
| 7,004,240 | B1 * | 2/2006 | Kroliczek et al. | 165/104.26 |
| 7,051,794 | B2 | 5/2006 | Luo | |
| 7,251,889 | B2 * | 8/2007 | Kroliczek et al. | 165/272 |
| 7,503,185 | B2 * | 3/2009 | Narayanamurthy et al. | 62/59 |
| 7,708,053 | B2 * | 5/2010 | Kroliczek et al. | 165/104.21 |
| 7,827,807 | B2 * | 11/2010 | Narayanamurthy et al. | 62/59 |
| 2002/0062648 | A1 | 5/2002 | Ghoshal | |
| 2003/0051857 | A1 | 3/2003 | Cluzet et al. | |
| 2004/0182550 | A1 | 9/2004 | Kroliczek et al. | |
| 2004/0206479 | A1 | 10/2004 | Kroliczek et al. | |
| 2005/0061487 | A1 | 3/2005 | Kroliczek et al. | |

FOREIGN PATENT DOCUMENTS

| | | |
|---|---|---|
| EP | 0210337 | 2/1987 |
| EP | 0355921 B1 | 7/1994 |
| EP | 0700737 A2 | 3/1996 |
| EP | 0987509 | 3/2000 |
| HU | 212748 B | 9/1995 |
| JP | 2000055577 | 2/2000 |
| JP | 2000241089 | 9/2000 |
| RU | 2098733 | 3/1995 |
| SU | 1467354 | 1/1987 |
| WO | 0210661 | 2/2002 |
| WO | 03054469 | 7/2003 |
| WO | 2004031675 | 4/2004 |
| WO | 2004040218 | 5/2004 |

OTHER PUBLICATIONS

"A high power spacecraft thermal management system," J. Ku, et al., AIAA-1988-2702, Thermophysics, Plasmadynamics and Lasers Conference, San Antonio, TX, Jun. 27-29, 1988, 12 pages.

"A methodology for enveloping reliable start-up of LHPS," Jane Baumann et al., AIAA-2000-2285, AIAA Thermophysics Conference, 34th, Denver, Co, Jun. 19-22, 2000, 9 pages.

"Across-Gimbal and Miniaturized Cryogenic Loop Heat Pipes," Bugby, D. et al., CP654, Space Technology and Applications International Forum-STAIF 2003, edited by M.S. El-Genk, American Institute of Physics, 2003, pp. 218-226.

"Advanced Capillary Pumped Loop (A-CPL) Project Summary," Hoang, Contract No. NAS5-98103, Mar. 1994, pp. 1-37.

"Advanced Components for Cryogenic Integration," Bugby, D. et al., Cryocoolers 12, edited by R.G. Ross, Jr., Kluwer Academic/Plenum Publishers, 2003, pp. 693-708.

"Advanced Components for Cryogenic Integration," D. Bugby et al, Proceedings of the 12th International Crycooler Conference, held Jun. 18-20, 2002, in Cambridge MA., 15 pages.

"Advanced Components and Techniques for Cryogenic Integration," D. Bugby et al., Environmental systems-International conference; 31st, Society of Automotive Engineers New York, 2001-01-2378, Orlando, FL 2001; (Jul. 2001), 9 pages.

"Advanced Components and Techniques for Cryogenic Integration," D. Bugby et al., presented at 2002 Spacecraft Thermal Control Symposium by Swales Aerospace, El Segundo, CA, Mar. 2002, 14 pages.

"An Improved High Power Hybrid Capillary Pumped Loop," J. Ku et al., paper submitted to SAE 19th Intersociety Conference on Environment Systems, SAE 891566, San Diego, CA, Jul. 24027, 1989, 10 pages.

"Design and Experimental Results of the HPCPL," Van Oost et al., ESTEC CPL-96 Workshop, Noordwijk, Netherlands, 1996, 29 pages.

"Design and Test of a Proof-of-Concept Advanced Capillary Pumped Loop," Triem T. Hoang, Society of Automotive Engineers, presented at the 27th Environmental systems International conference, New York, 1997, Paper 972326, 6 pages.

"Design and Test Results of Multi-Evaporator Loop Heat Pipe," Yun, Seokgeun, et al., SAE Paper No. 1999-01-2051, 29th International Conference on Environmental Systems, Jul. 1999, 7 pages.

"Design and Testing of a 40 W Free-Piston Stirling Cycle Cooling Unit," Berchowitz, D. M. et al., 20th International Conference of Refrigeration, IIR/IIF, Sydney, 1999, 7 pages.

"Design and Testing of a High Power Spacecraft Thermal Management System," McCabe, Jr., Michael E. et al., National Aeronautics and Space Administration (NASA), NASA Technical Memorandum 4051, Scientific and Technical Information Division, 1988, 107 pages.

"Development and Testing of a Gimbal Thermal Transport System," D. Bugby et al., Proceedings of the 11th International Cryocooler Conference, held Jun. 20-22, 2000, in Keystone, Colorado, 11 pages.

"Development of a Cryogenic Loop Heat Pipe (CLHP) for Passive Optical Bench Cooling Applications," James Yun, et al., 32nd International Conference on Environmental Systems (ICES-2002), Society of Automotive Engineers Paper No. 2002-01-2507, San Antonio, Texas, 2002, 9 pages.

"Development of an Advanced Capillary Pumped Loop," Triem T. Hoang et al., Society of Automotive Engineers, presented at the 27th Environmental systems International conference, New York, 1997, Paper 972325, 6 pages.

"Development of Advenced Cyrogenic Integration Solutions," D. Bugby et al., presented at the 10th International Cryocoolers Conference on May 26-28, 1998 in Monterey, CA and published in "Cryocoolers 10," by Ron Ross, Jr., Kluwer Academic/Plenum Publishers, NY 1999, 17 pages.
"Energy Efficient Freezer Installation Using Natural Working Fluids and a Free Piston Stirling Cooler," Welty, Stephen C. et al., VI Congreso Iberoamericano De Aire Acondicionado Y Refreigeracion, CIAR 2001, Trabajo No. 96, pp. 199-208, Aug. 15-17, 2001.
"Experimental Investigation of a Stirling Cycle Cooled Domestic Refrigerator,"Oguz, Emre et al., 9th Proceedings of the International Refrigeration and Air Conditioning Conference at Purdue, 2002; 9th; vol. 2, pp. 777-784.
"Free-Piston Rankine Compression and Stirling Cycle Macines for Domestic Refrigeration,"Berchowitz, David M., Presented at the Greenpeace Ozon Safe Conference, Washington, DC, Oct. 18-19, 1993.
"Hydrogen Loop Pipe Design & Test Results," O'Connell et al., presented at 2002 Spacecraft Thermal Control Symposium by TTH Reserach, El Segundo, CA, Mar. 2002, 14 pages.
"Maximized Performance of Stirling Cycle Refrigerators," Berchowitz, D.M., Natural working fluids '98 IIR-Gustav Lorentzen Conference: Oslo, Norway, Jun. 2-5, 1998, Fluides actifs naturels conference IIF-Gustav Lorentzen, Journal: Science et technique du froid, 1998 (4) 422-429.
"Measurement and application of performance characteristics of a Free Piston Stirling Cooler," Janssen, Martien et al., 9th International Refrigeration and Air Conditioning Conference, Jul. 16-19, 2002, 8 pages.
"Methods of Increase of the Evaporators Reliability for Loop Heat Pipes and Capillary Pumped Loops," Kotlyarov, E. Yu et al., 24th International Conference on Environmental Systems, Jun. 20-23, 1994, 941578, 7 pages.
"Multiple Evaporator Loop Heat Pipe," James Yun, et al., Society of Automotive Engineers, 2000-01-2410, 30th International Conference on Environmental Systems, Jul. 10-13, 2000, 10 pages.
"Operational Characteristics of Loop Heat Pipes," Jentung Ku, 29th International Conference on Environmental Systems, Denver, CO, Jul. 12-15, 1999, 17 pages.
"Operational Characteristics of Stirling Machinery," Kwon, Yong-Rak et al., International Congress of Refrigeration, Aug. 17-22, 2003, 8 pages.
"Recent Advences in Capillary Pumped Loop Technology," J. Ku, 1997 National Heat Transfer Conference, Baltimore, MD, Aug. 10-12, 1997, AIAA 97-3870, 22 pages.
"Recent Advences in Stirling Cycle Refrigeration," Berchowitz, D. M. et al., 1995, 19th International Conference of Refrigeration, The Hague, The Netherlands, 8 pages.
"Testing of a Caprillary Pumped Loop with Multiple parallel starter pumps," J. Ku et al, SAE Paper No. 972329, 1997.
"Test Results of Relable and Very High Capillary Multi-Evaporators/Condenser Loop," Van Oost, Stephane et al., 25th International Conference on Environmental Systems, Jul. 10-13, 1995, 6 pages.
"The Hybrid Capillary Pumped Loop," J. Ku et al., paper submitted to SAE 18th Ingersociety Conference on Environmental Systems, SAE 881083, San Francisco, CA, Jul. 11-13, 1988, 11 pages.
"The Proof-of-feasibility of Multiple Evaporator Loop Heat Pipes," W.B. Bienert et al., Proceedings of the Eighth Annual Spacecraft Thermal Control Workshop, 1997, 8 pages.
"The Application of Stirling Cooler to Refrigeration," Kim, Seon-Young et al., IECEC-97-Intersociety Energy Conversion Engineering Conference, 1997, Conference 32, vol. 2, pp. 1023-1026.
PCT International Preliminary Examination Report for Application No. PCT/US03/34165, dated Mar. 8, 2007, 3 pages.
PCT International Search Report for Application No. PCT/US04/35548, dated Oct. 1, 2005.

* cited by examiner

THERMAL MANAGEMENT SYSTEMS

CROSS-REFERENCE TO RELATED APPLICATIONS

This application is a continuation of U.S. patent application Ser. No. 10/890,382, filed Jul. 14, 2004, now U.S. Pat. No. 7,549,461, issued Jun. 23, 2009, which claims priority to U.S. Provisional Application Ser. No. 60/486,467, filed Jul. 14, 2003, and is a continuation-in-part of U.S. patent application Ser. No. 10/602,022, filed Jun. 24, 2003, now U.S. Pat. No. 7,004,240, issued Feb. 28, 2006, which claims priority to U.S. Provisional Patent Application Ser. No. 60/391,006, filed Jun. 24, 2002, and is a continuation-in-part of U.S. patent application Ser. No. 09/896,561, filed Jun. 29, 2001, now U.S. Pat. No. 6,889,754, issued May 10, 2005, which itself claims priority to U.S. Patent Provisional Application Ser. No. 60/215,588, filed Jun. 30, 2000. These applications are herein incorporated in their entirety.

TECHNICAL FIELD

This description relates to a system for heat transfer.

BACKGROUND

Heat transport systems are used to transport heat from one location (the heat source) to another location (the heat sink). Heat transport systems can be used in terrestrial or extraterrestrial applications. For example, heat transport systems may be integrated by satellite equipment that operates within zero- or low-gravity environments. As another example, heat transport systems can be used in electronic equipment, which often requires cooling during operation.

Loop Heat Pipes (LHPs) and Capillary Pumped Loops (CPLs) are passive two-phase heat transport systems. Each includes an evaporator thermally coupled to the heat source, a condenser thermally coupled to the heat sink, fluid that flows between the evaporator and the condenser, and a fluid reservoir for expansion of the fluid. The fluid within the heat transport system can be referred to as the working fluid. The evaporator includes a primary wick and a core that includes a fluid flow passage. Heat acquired by the evaporator is transported to and discharged by the condenser. These systems utilize capillary pressure developed in a fine-pored wick within the evaporator to promote circulation of working fluid from the evaporator to the condenser and back to the evaporator. The primary distinguishing characteristic between a LHP and a CPL is the location of the loop's reservoir, which is used to store excess fluid displaced from the loop during operation. In general, the reservoir of a CPL is located remotely from the evaporator, while the reservoir of a LHP is co-located with the evaporator.

SUMMARY

According to one general aspect, a system includes a primary evaporator operable to facilitate heat transfer by evaporating received liquid to obtain vapor, the primary evaporator including a first port for receiving the liquid from a liquid line, a second port for outputting the vapor to a vapor line, and a third port for outputting excess liquid received from the liquid line to an excess fluid line. A condensing system is operable to receive the vapor from the vapor line, to condense at least some of the vapor, and to output the liquid to the liquid line. A reservoir is in fluid communication with the condensing system, and the liquid is obtained at least partially from the reservoir. In the system, a primary loop includes the condensing system, the primary evaporator, the liquid line, and the vapor line, the primary loop being operable to provide a heat transfer path, and a secondary loop includes the condensing system, the primary evaporator, the liquid line, the vapor line, and the excess fluid line. The secondary loop is operable to provide a venting path for removing other vapor that is present within the liquid from the primary evaporator.

Implementations may include one or more of the following features. For example, the liquid in the primary evaporator and received from the liquid line may include the excess liquid in excess of a liquid amount necessary to maintain saturation of a primary wick within a core of the primary evaporator. In this case, the primary evaporator may include a secondary wick that is operable to perform phase separation of the other vapor from the liquid for output through the excess fluid line. Further, the primary wick and the secondary wick of the primary evaporator may maintain capillary pumping of the liquid, the excess liquid, and the vapor, so as to maintain flow control to and through the primary evaporator.

A mechanical pump may be included that is operable to facilitate the heat transfer by actively pumping the liquid for evaporation by the primary evaporator, and for output as the excess liquid flows through the third port to the excess fluid line. In this case, the reservoir may be positioned between an output of the condensing system and an input of the mechanical pump, or the mechanical pump may be positioned between an input of the condensing system and an output of the primary evaporator.

A bypass valve may be included in parallel with the mechanical pump, and may be operable to bypass the mechanical pump during a passive pumping operation of the liquid for evaporation by the primary evaporator. The mechanical pump may include a liquid pump that is oriented in series with the liquid line and positioned between the condensing system and the primary evaporator, or a vapor compressor that is oriented in series with the vapor line and positioned between the primary evaporator and the condensing system.

A sensor may be included that is operable to communicate a saturation level of a wick of the primary evaporator to the mechanical pump, wherein a pumping pressure delivered by the mechanical pump is adjusted, based on the saturation level, so as to maintain saturation of the wick with the liquid. A liquid bypass valve may be connected between the liquid line and the vapor line and may be operable to maintain constant pump speed operations of the mechanical pump. The primary evaporator may include a primary wick and a secondary wick, compositions of which may comprise metal.

A priming system may be included within the secondary loop, and the priming system may include a secondary evaporator coupled to the vapor line, and a secondary reservoir may be in fluid communication with the secondary evaporator and coupled to the primary evaporator by the excess fluid line, wherein the priming system may be operable to provide the liquid to the primary evaporator at least partially from the secondary reservoir. The condensing system may include a first condenser within the primary loop and coupled to the liquid line and to the vapor line, and a second condenser within the secondary loop and coupled to the excess fluid line and to the secondary reservoir.

The third port of the primary evaporator may be primarily used to output the excess liquid to the excess fluid line, and the third port may include a subport for outputting the other vapor to a vapor line, such that the vapor line is included within the secondary loop.

The liquid line may be coaxial to and contained within the excess fluid line. A second primary evaporator may be connected in parallel with the primary evaporator within the primary loop. A back pressure regulator may be oriented in series with the vapor line and positioned between the primary evaporator and the condensing system, and may be operable to substantially equalize heat load between the primary evaporator and the secondary primary evaporator. In this case, the back pressure regulator may restrict vapor from reaching the condensing system until a vapor space of the primary evaporator and of the second primary evaporator is substantially devoid of liquid.

A second primary evaporator may be oriented in series with the primary evaporator within the primary loop. The condensing system may include a plurality of condensers connected in parallel to one another. In this case, liquid outputs may be associated with each of the plurality of condensers and may be operable to output the liquid to the primary evaporator, and condenser regulators may be coupled to the liquid outputs and operable to regulate liquid flow therefrom.

A second primary evaporator may be connected with the primary evaporator within the primary loop, and a thermal storage unit may be coupled to the second primary evaporator. A second primary evaporator may be connected with the primary evaporator within the primary loop, and first and second flow controllers may be connected to the primary evaporator and the second primary evaporator, respectively, and may be operable to regulate liquid flow to the primary evaporator and the second primary evaporator, respectively, so as to ensure a substantially equal heat load distribution between the evaporators.

A second primary evaporator may be connected with the primary evaporator within the primary loop, and a condensing heat exchanger may be coupled to the second primary evaporator. A spray-cooled evaporator may be coupled to the condensing heat exchanger by way of a mechanical pump. The condensing system may include a body-mounted radiator, or may include a deployable or steerable radiator.

According to another general aspect, liquid is evaporated from a primary wick of a primary evaporator to thereby obtain vapor, the vapor is output through a vapor line coupled to the primary evaporator, and the vapor from the vapor line is condensed within a condensing system. The liquid is returned to the primary evaporator through a liquid line coupled to the primary evaporator, where a saturation amount of the liquid is provided so as to maintain a saturation of the primary wick during the evaporating. Excess liquid beyond the saturation amount is provided to the primary evaporator at least partially from a reservoir, through the liquid line, and the excess liquid and other vapor within the primary evaporator is swept to the condensing system.

Implementations may include one or more of the following features. For example, in evaporating liquid from the primary wick of the primary evaporator capillary pumping of the liquid, the excess liquid, and the vapor may be maintained, so as to maintain flow control to and through the primary evaporator.

Also, in outputting the vapor, the vapor may be output through a first port of the primary evaporator. In returning the liquid and providing excess liquid, the liquid and excess liquid may be returned through a second port of the primary evaporator. In sweeping the excess liquid and undesired vapor, the excess liquid and undesired vapor may be swept from a third port of the primary evaporator.

Outputting the vapor may include outputting the vapor through a first port of the primary evaporator. Returning the liquid and providing excess liquid may include returning the liquid and excess liquid through a second port of the primary evaporator, and sweeping the excess liquid and other vapor may include sweeping the excess liquid from a third port of the primary evaporator, and sweeping the other vapor from a fourth port of the primary evaporator.

Sweeping the excess liquid and other vapor may include separating the liquid and excess liquid from the other vapor with a secondary wick of the primary evaporator. Providing the excess liquid may include pumping the excess liquid from the reservoir using a mechanical pump. In this case, the mechanical pump may be bypassed using a bypass valve in parallel with the mechanical pump, during a passive pumping operation of the liquid for evaporation by the primary evaporator.

Pumping the excess liquid may include pumping the liquid and the excess liquid using a liquid pump that is oriented in series with the liquid line and positioned between the condensing system and the primary evaporator, or may include pumping the vapor to the condensing system using a vapor compressor that is oriented in series with the vapor line and positioned between the primary evaporator and the condensing system.

Providing excess liquid may include providing the excess liquid from a priming system in which the reservoir is in fluid communication with a secondary evaporator, where the reservoir may be coupled to the primary evaporator. In this case, condensing the vapor may include condensing the vapor within a first condenser of the condensing system, the first condenser being coupled to the liquid line and to the vapor line, and sweeping the excess liquid and undesired vapor may include condensing undesired vapor within a second condenser of the condensing system, where the second condenser may be coupled to a mixed fluid line and to the reservoir.

According to another general aspect, a system includes a heat transfer system including a main evaporator having a core, a primary wick, a secondary wick, a first port, a second port, and a third port, as well as a condenser coupled to the main evaporator by a liquid line and a vapor line. A heat transfer system loop is defined by the condenser, the liquid line, the vapor line, the first port, and the second port. A venting system is configured to remove vapor bubbles from the core of the main evaporator. The venting system includes a pumping system operable to provide excess liquid to the main evaporator beyond a saturation amount of liquid needed for saturating the primary wick, and a reservoir in fluid communication with the pumping system and providing the excess liquid. The vapor bubbles are vented from the core of the main evaporator through the third port, and a venting loop is defined by the condenser, the liquid line, the vapor line, the first port of the main evaporator, and the third port of the main evaporator.

Implementations may include one or more of the following features. For example, the pumping system may include a mechanical pump.

The primary wick and the secondary wick of the main evaporator may maintain capillary pumping of the liquid, the excess liquid, and the vapor, so as to maintain flow control to and through the primary evaporator. In this case, the pumping system may include a secondary evaporator in fluid communication with the reservoir and coupled to the vapor line. Further, the reservoir may be in fluid communication with the secondary wick of the main evaporator through a mixed fluid line coupled to the third port of the main evaporator. The excess liquid may be substantially removed from the core of the main evaporator through a fourth port of the main evaporator.

Other features will be apparent from the description, the drawings, and the claims.

DESCRIPTION OF DRAWINGS

Like reference symbols in the various drawings generally indicate like elements.

DETAILED DESCRIPTION

As discussed above, in a loop heat pipe (LHP), the reservoir is co-located with the evaporator, the reservoir is thermally and hydraulically connected with the evaporator through a heat-pipe-like conduit. In this way, liquid from the reservoir can be pumped to the evaporator, thus ensuring that the primary wick of the evaporator is sufficiently wetted or "primed" during start-up. Additionally, the design of the LHP reduces depletion of liquid from the primary wick of the evaporator during steady-state or transient operation of the evaporator within a heat transport system. Moreover, vapor and/or bubbles of non-condensable gas (NCG bubbles) vent from a core of the evaporator through the heat-pipe-like conduit into the reservoir.

Conventional LHPs require liquid to be present in the reservoir prior to start-up, that is, application of power to the evaporator of the LHP. However, liquid will not be present in the reservoir prior to start-up if, prior to start-up of the LHP, the working fluid in the LHP is in a supercritical state in which a temperature of the LHP is above the critical temperature of the working fluid. The critical temperature of a fluid is the highest temperature at which the fluid can exhibit a liquid-vapor equilibrium. For example, the LHP may be in a supercritical state if the working fluid is a cryogenic fluid, that is, a fluid having a boiling point below 150° C., or if the working fluid is a sub-ambient fluid, that is, a fluid having a boiling point below the temperature of the environment in which the LHP is operating.

Conventional LHPs also require liquid returning to the evaporator to be subcooled, that is, cooled to a temperature that is lower than the boiling point of the working fluid. Such a constraint makes it impractical to operate LHPs at a sub-ambient temperature. For example, if the working fluid is a cryogenic fluid, the LHP is likely operating in an environment having a temperature greater than the boiling point of the fluid.

Figure 1:
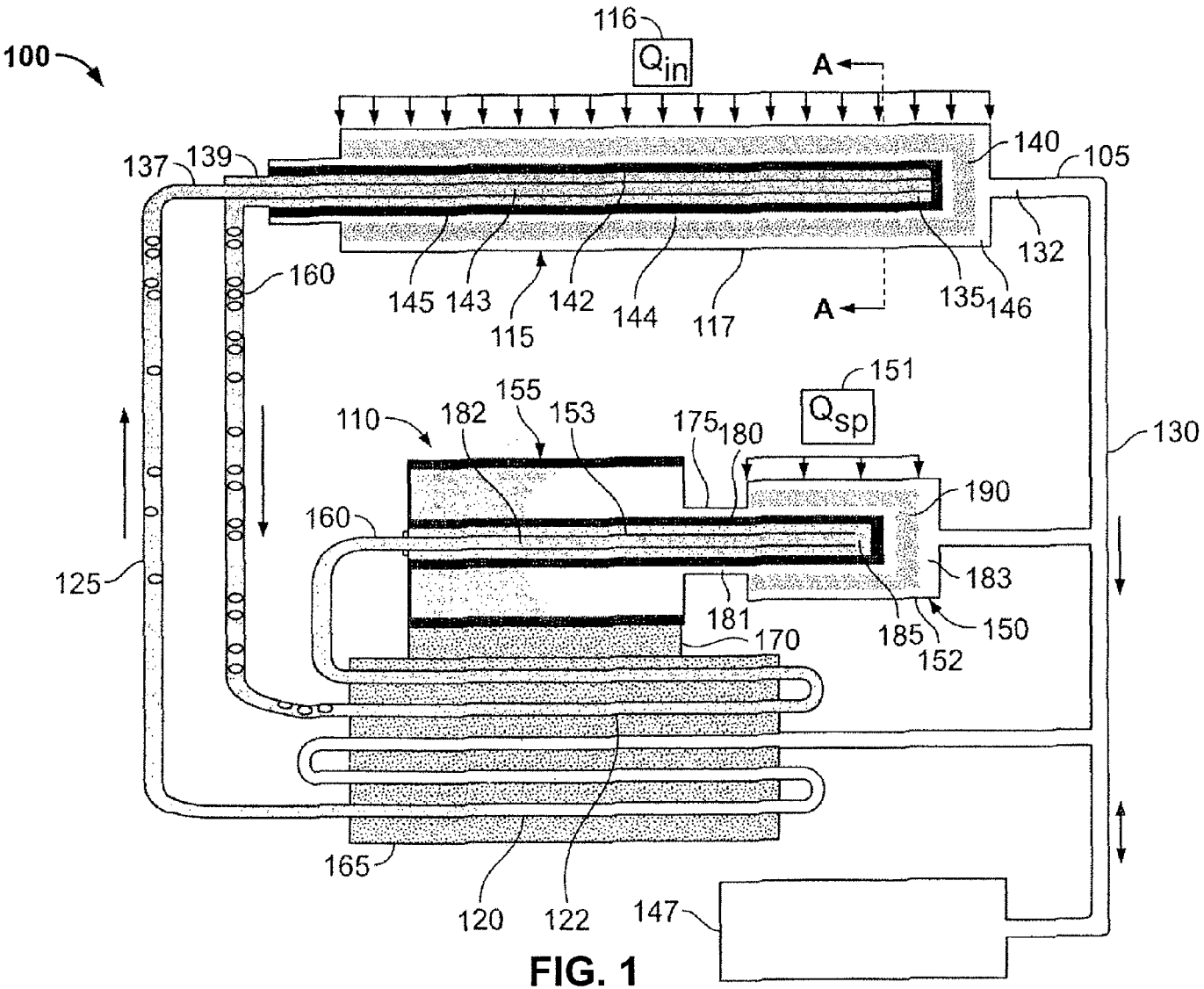
FIG. 1 is a schematic diagram of a heat transport system.

Referring to FIG. 1, a heat transport system 100 is designed to overcome limitations of conventional LHPs, which may include those noted above. The heat transport system 100 includes a heat transfer system 105 and a priming system 110. The priming system 110 is configured to convert fluid within the heat transfer system 105 into a liquid, thus priming the heat transfer system 105. As used in this description, the term "fluid" is a generic term that refers to a substance that may be both a liquid and a vapor in saturated equilibrium.

The heat transfer system 105 includes a main evaporator 115, and a condenser 120 coupled to the main evaporator 115 by a liquid line 125 and a vapor line 130. The condenser 120 is in thermal communication with a heat sink 165, and the main evaporator 115 is in thermal communication with a heat source $Q_{in}$ 116. The heat transfer system 105 also may include a hot reservoir 147 coupled to the vapor line 130 for additional pressure containment, as needed. In particular, the hot reservoir 147 increases the volume of the heat transport system 100. If the working fluid is at a temperature above its critical temperature, that is, the highest temperature at which the working fluid can exhibit liquid-vapor equilibrium, its pressure is proportional to the mass in the heat transport system 100 (the charge) and inversely proportional to the volume of the heat transfer system 105. Increasing the volume with the hot reservoir 147 lowers the fill pressure.

The main evaporator 115 includes a container 117 that houses a primary wick 140 within which a core 135 is defined. The main evaporator 115 includes a bayonet tube 142 and a secondary wick 145 within the core 135. The bayonet tube 142, the primary wick 140, and the secondary wick 145 define a liquid passage 143, a first vapor passage 144, and a second vapor passage 146. The secondary wick 145 provides phase control, that is, liquid/vapor separation in the core 135, as discussed in U.S. application Ser. No. 09/896,561, filed Jun. 29, 2001, now U.S. Pat. No. 6,889,754, issued May 10, 2005, which is incorporated herein by reference in its entirety. As shown, the main evaporator 115 has three ports, a liquid inlet 137 into the liquid passage 143, a vapor outlet 132 into the vapor line 130 from the second vapor passage 146, and a fluid outlet 139 from the liquid passage 143 (and possibly the first vapor passage 144, as discussed below). Further details on the structure of a three-port evaporator are discussed below with respect to FIGS. 5A and 5B.

The priming system 110 includes a secondary or priming evaporator 150 coupled to the vapor line 130 and a reservoir 155 co-located with the secondary evaporator 150. The reservoir 155 is coupled to the core 135 of the main evaporator 115 by a secondary fluid line 160 and a secondary condenser 122. The secondary fluid line 160 couples to the fluid outlet 139 of the main evaporator 115. The priming system 110 also includes a controlled heat source $Q_{sp}$ 151 in thermal communication with the secondary evaporator 150.

The secondary evaporator 150 includes a container 152 that houses a primary wick 190 within which a core 185 is defined. The secondary evaporator 150 includes a bayonet tube 153 and a secondary wick 180 that extends from the core 185, through a conduit 175, and into the reservoir 155. The secondary wick 180 provides a capillary link between the reservoir 155 and the secondary evaporator 150. The bayonet tube 153, the primary wick 190, and the secondary wick 180 define a liquid passage 182 coupled to the secondary fluid line 160, a first vapor passage 181 coupled to the reservoir 155, and a second vapor passage 183 coupled to the vapor line 130. The reservoir 155 is thermally and hydraulically coupled to the core 185 of the secondary evaporator 150 through the liquid passage 182, the secondary wick 180, and the first vapor passage 181. Vapor and/or NCG bubbles from the core 185 of the secondary evaporator 150 are swept through the first vapor passage 181 to the reservoir 155 and condensable liquid is returned to the secondary evaporator 150 through the secondary wick 180 from the reservoir 155. The primary wick 190 hydraulically links liquid within the core 185 of the secondary evaporator 150 to the controlled heat source $Q_{sp}$ 151, permitting liquid at an outer surface of the primary wick 190 to evaporate and form vapor within the second vapor passage 183 when heat is applied to the secondary evaporator 150.

The reservoir 155 is cold-biased, and thus, it is cooled by a cooling source that will allow it to operate, if unheated, at a temperature that is lower than the temperature at which the heat transfer system 105 operates. In one implementation, the reservoir 155 and the secondary condenser 122 are in thermal communication with the heat sink 165 that is thermally coupled to the condenser 120. For example, the reservoir 155 can be mounted to the heat sink 165 using a shunt 170, which may be made of a heat conductive material, such as aluminum, for example. In this way, the temperature of the reservoir 155 tracks the temperature of the condenser 120.

Figure 2:
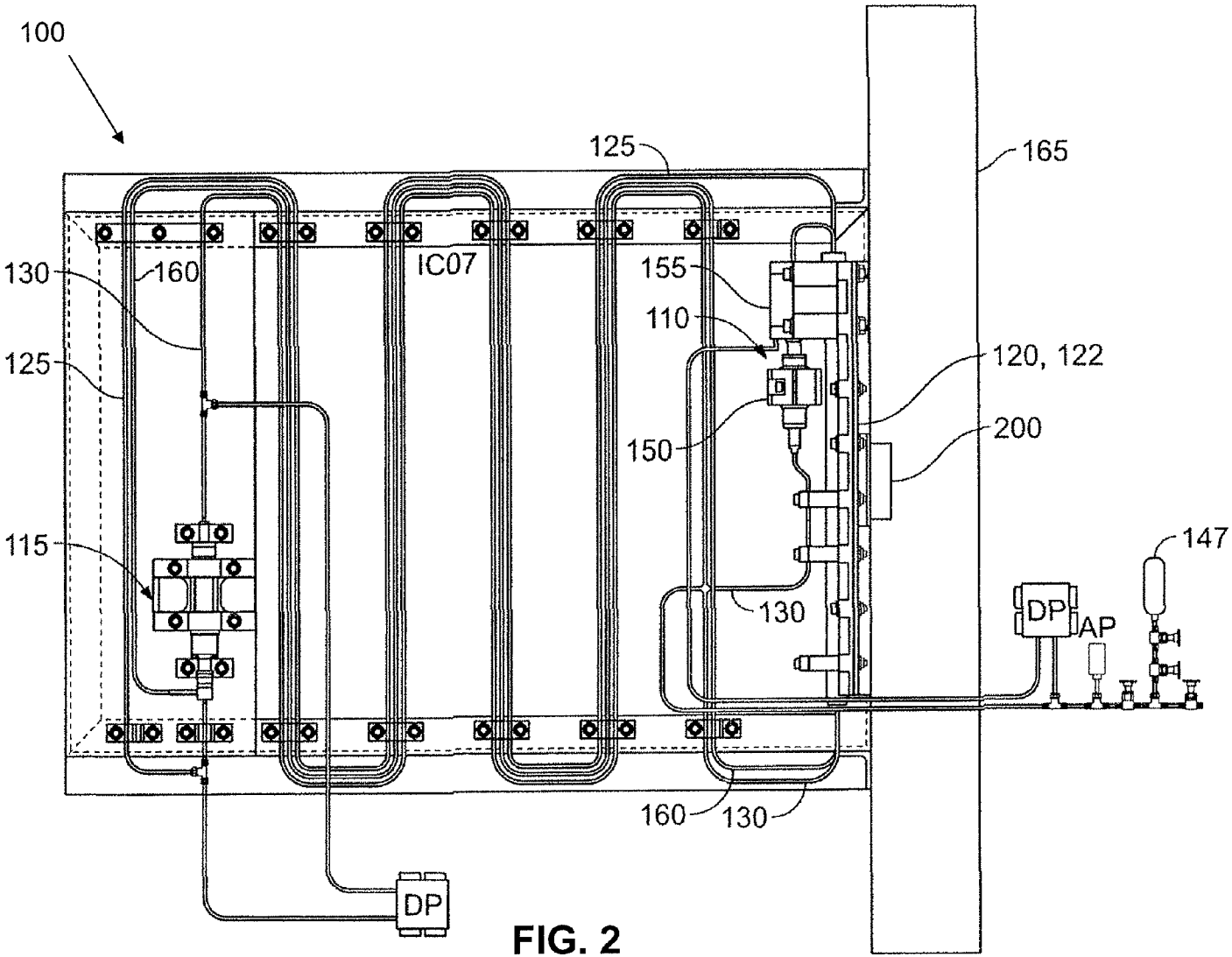
FIG. 2 is a diagram of an implementation of the heat transport system schematically shown by FIG. 1.

FIG. 2 shows an example of an implementation of the heat transport system 100. In this implementation, the condensers 120 and 122 are mounted to a cryocooler 200, which acts as a refrigerator, transferring heat from the condensers 120, 122 to the heat sink 165. Additionally, in the implementation of FIG. 2, the lines 125, 130, 160 are wound to reduce space requirements for the heat transport system 100.

Though not shown in FIGS. 1 and 2, elements such as, for example, the reservoir 155 and the main evaporator 115, may be equipped with temperature sensors that can be used for diagnostic or testing purposes.

Figure 3:
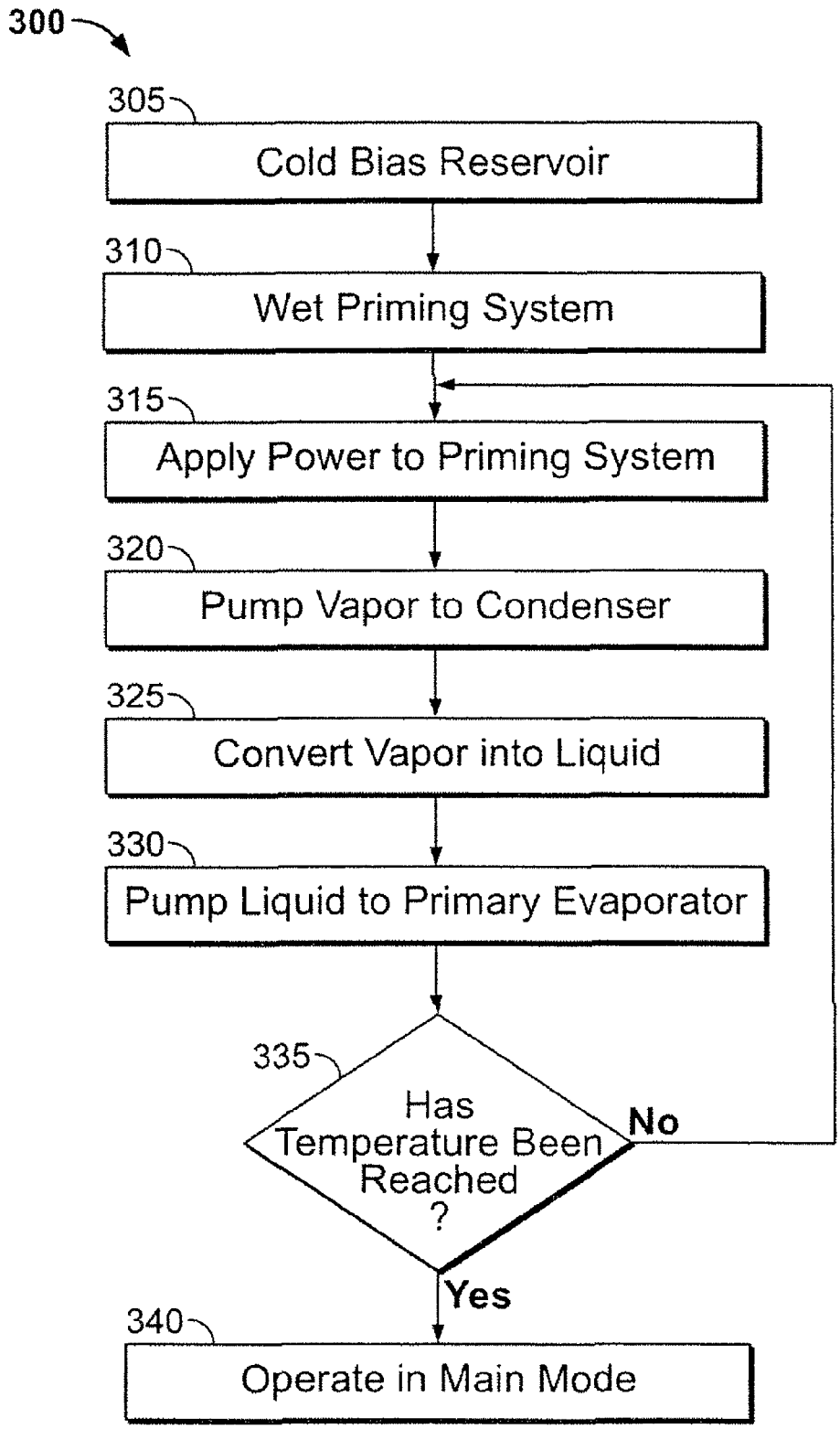
FIG. 3 is a flow chart of a procedure for transporting heat using a heat transport system.

Referring also to FIG. 3, the heat transport system 100 performs a procedure 300 for transporting heat from the heat source $Q_{in}$ 116 and for ensuring that the main evaporator 115 is wetted with liquid prior to startup. The procedure 300 is particularly useful when the heat transfer system 105 is at a supercritical state. Prior to initiation of the procedure 300, the heat transport system 100 is filled with a working fluid at a particular pressure, referred to as a "fill pressure."

Initially, the reservoir 155 is cold-biased by, for example, mounting the reservoir 155 to the heat sink 165 (step 305). The reservoir 155 may be cold-biased to a temperature below the critical temperature of the working fluid, which, as discussed, is the highest temperature at which the working fluid can exhibit liquid-vapor equilibrium. For example, if the fluid is ethane, which has a critical temperature of 33° C., the reservoir 155 is cooled to below 33° C. As the temperature of the reservoir 155 drops below the critical temperature of the working fluid, the reservoir 155 partially fills with a liquid condensate formed by the working fluid. The formation of liquid within the reservoir 155 wets the secondary wick 180 and the primary wick 190 of the secondary evaporator 150 (step 310).

Meanwhile, power is applied to the priming system 110 by applying heat from the controlled heat source $Q_{sp}$ 151 to the secondary evaporator 150 (step 315) to enhance or initiate circulation of fluid within the heat transfer system 105. Vapor output by the secondary evaporator 150 is pumped through the vapor line 130 and through the condenser 120 (step 320) due to capillary pressure at the interface between the primary wick 190 and the second vapor passage 183. As vapor passes through the condenser 120, it is converted to liquid (step 325). The liquid formed in the condenser 120 is pumped to the main evaporator 115 of the heat transfer system 105 (step 330). When the main evaporator 115 is at a higher temperature than the critical temperature of the fluid, the liquid entering the main evaporator 115 evaporates and cools the main evaporator 115. This process (steps 315-330) continues, causing the main evaporator 115 to reach a set point temperature (step 335), at which point the main evaporator 115 is able to retain liquid and be wetted and to operate as a capillary pump. In one implementation, the set point temperature is the temperature to which the reservoir 155 has been cooled. In another implementation, the set point temperature is a temperature below the critical temperature of the working fluid. In a further implementation, the set point temperature is a temperature above the temperature to which the reservoir 155 has been cooled.

Once the set point temperature has been reached (step 335), the heat transport system 100 operates in a main mode (step 340) in which heat from the heat source $Q_{in}$ 116 that is applied to the main evaporator 115 is transferred by the heat transfer system 105. Specifically, in the main mode, the main evaporator 115 develops capillary pumping to promote circulation of the working fluid through the heat transfer system 105. Also, in the main mode, the temperature of the reservoir 155 may be reduced below the set point temperature of the main evaporator 115. The rate at which the heat transfer system 105 cools down during the main mode depends, in part, on the cold-biasing of the reservoir 155 because the temperature of the main evaporator 115 closely follows the temperature of the reservoir 155. Additionally, though not necessarily, a heater can be used to further control or regulate the temperature of the reservoir 155 during the main mode (step 340). Furthermore, in the main mode, the power applied to the secondary evaporator 150 by the controlled heat source $Q_{sp}$ 151 is reduced, thus bringing the heat transfer system 105 down to a normal operating temperature for the fluid. For example, in the main mode, the heat load from the controlled heat source $Q_{sp}$ 151 to the secondary evaporator 150 is kept at a value equal to or in excess of heat conditions, as defined below. In one implementation, the heat load from the controlled heat source $Q_{sp}$ 151 is kept to about 5 to 10% of the heat load applied to the main evaporator 115 from the heat source $Q_{in}$ 116.

Thus, in the FIG. 3 implementation, the main mode is triggered by the determination that the set point temperature has been reached at the main evaporator 115 (step 335). In other implementations, the main mode may begin at other times or due to other triggers. For example, the main mode may begin after the priming system is wet (step 310) or after the reservoir has been cold-biased (step 305).

At any time during operation, the heat transfer system 105 can experience heat conditions that cause formation of vapor on the liquid side of the evaporator, such as those resulting from heat conduction across the primary wick 140 and parasitic heat applied to the liquid line 125. Specifically, heat conduction across the primary wick 140 can cause liquid in the core 135 to form vapor bubbles, which, if left within the core 135, would grow and block off liquid otherwise supplied to the primary wick 140, thus causing the main evaporator 115 to fail. One such heat condition is caused by parasitic heat input into the liquid line 125 (referred to as "parasitic heat gains"), which causes liquid within the liquid line 125 to form vapor.

To reduce the adverse impact of heat conditions such as those discussed above, the priming system 110 operates at a power level $Q_{sp}$ 450 (FIG. 4) that is greater than or equal to the sum of the heat conduction and the parasitic heat gains. As mentioned above, for example, the priming system 110 can operate at 5 to 10% of the power to the heat transfer system 105. In particular, fluid that includes a combination of vapor bubbles and liquid is swept out of the core 135 for discharge into the secondary fluid line 160 leading to the secondary condenser 122. In particular, vapor that forms within the core 135 travels along the bayonet tube 143 and directly into the fluid outlet port 139. Furthermore, vapor that forms within the first vapor passage 144 travels into the fluid outlet port 139 by either traveling through the secondary wick 145 (if the pore size of the secondary wick 145 is large enough to accommodate vapor bubbles) or through an opening (not shown) at an end of the secondary wick 145 near the outlet port 139 that provides a clear passage from the first vapor passage 144 to the outlet port 139. The secondary condenser 122 condenses the bubbles in the fluid and pushes the fluid to the reservoir 155 for reintroduction into the heat transfer system 105.

Figure 8A:
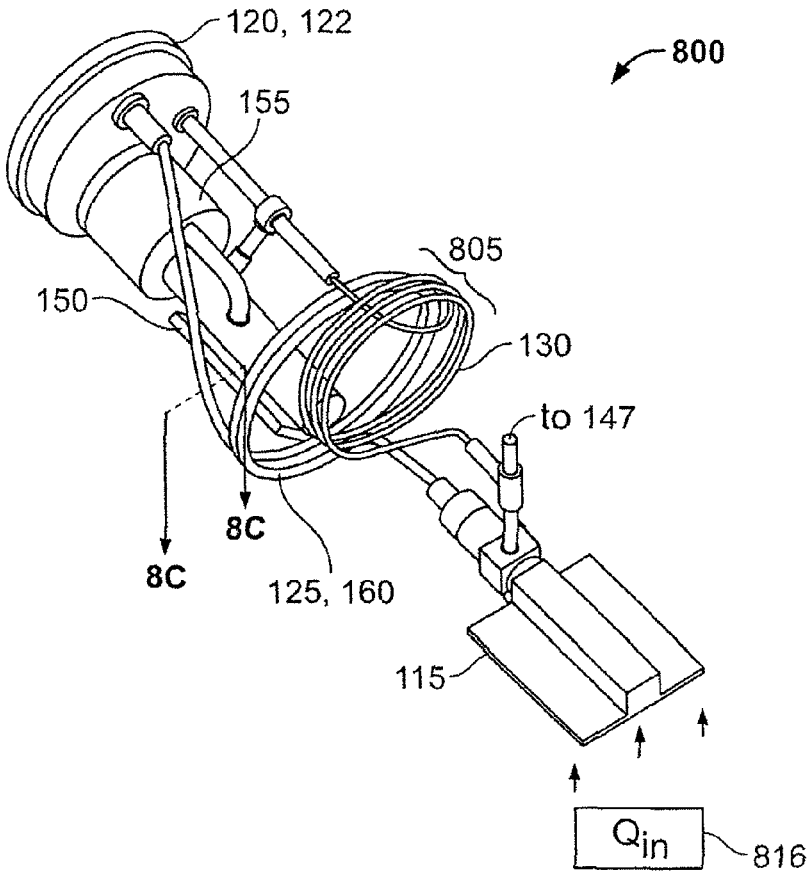
FIGS. 8A, 8B, 9A, and 9B are perspective views of applications using a heat transport system.
Figure 8B:
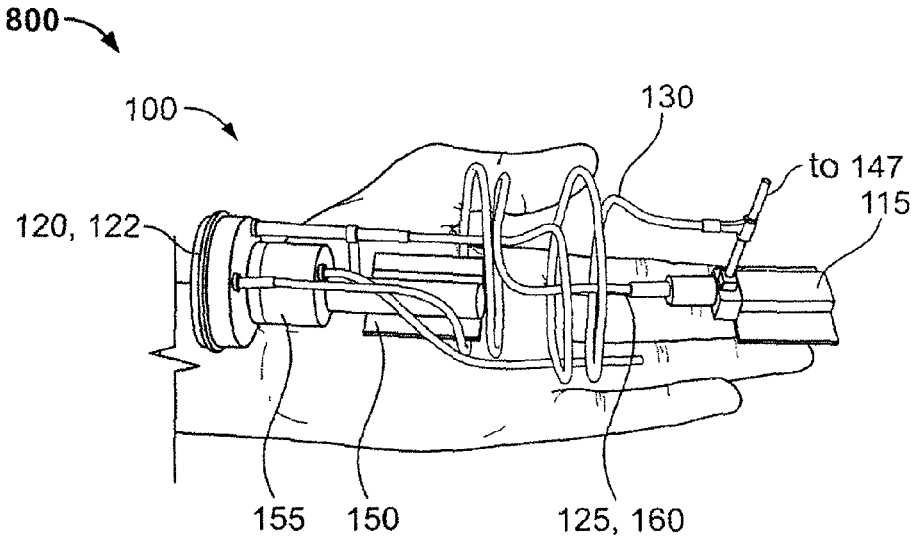
Figure 8C:
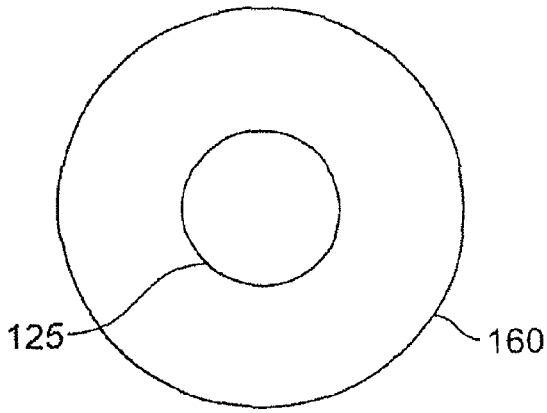
FIG. 8C is a cross-sectional view of a fluid line taken along section line 8C-8C of FIG. 8A.
Figure 8D:
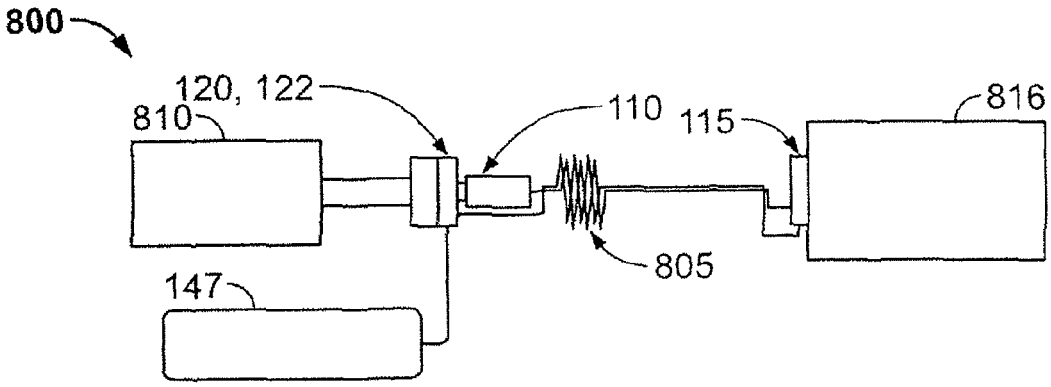
FIGS. 8D and 9C are schematic diagrams of the implementations of the heat transport systems of FIGS. 8A and 9A, respectively.

Similarly, to reduce parasitic heat input to the liquid line 125, the secondary fluid line 160 and the liquid line 125 can form a coaxial configuration such that the secondary fluid line 160 surrounds and insulates the liquid line 125 from surrounding heat. This implementation is discussed further below with reference to FIGS. 8A and 8B. As a consequence of this configuration, it is possible for the surrounding heat to cause vapor bubbles to form in the secondary fluid line 160, instead of in the liquid line 125. As discussed, by virtue of capillary action effected at the secondary wick 145, fluid flows from the main evaporator 115 to the secondary condenser 122. This fluid flow, and the relatively low temperature of the secondary condenser 122, causes a sweeping of the vapor bubbles within the secondary fluid line 160 through the condenser 122, where they are condensed into liquid and pumped into the reservoir 155.

Figure 4:
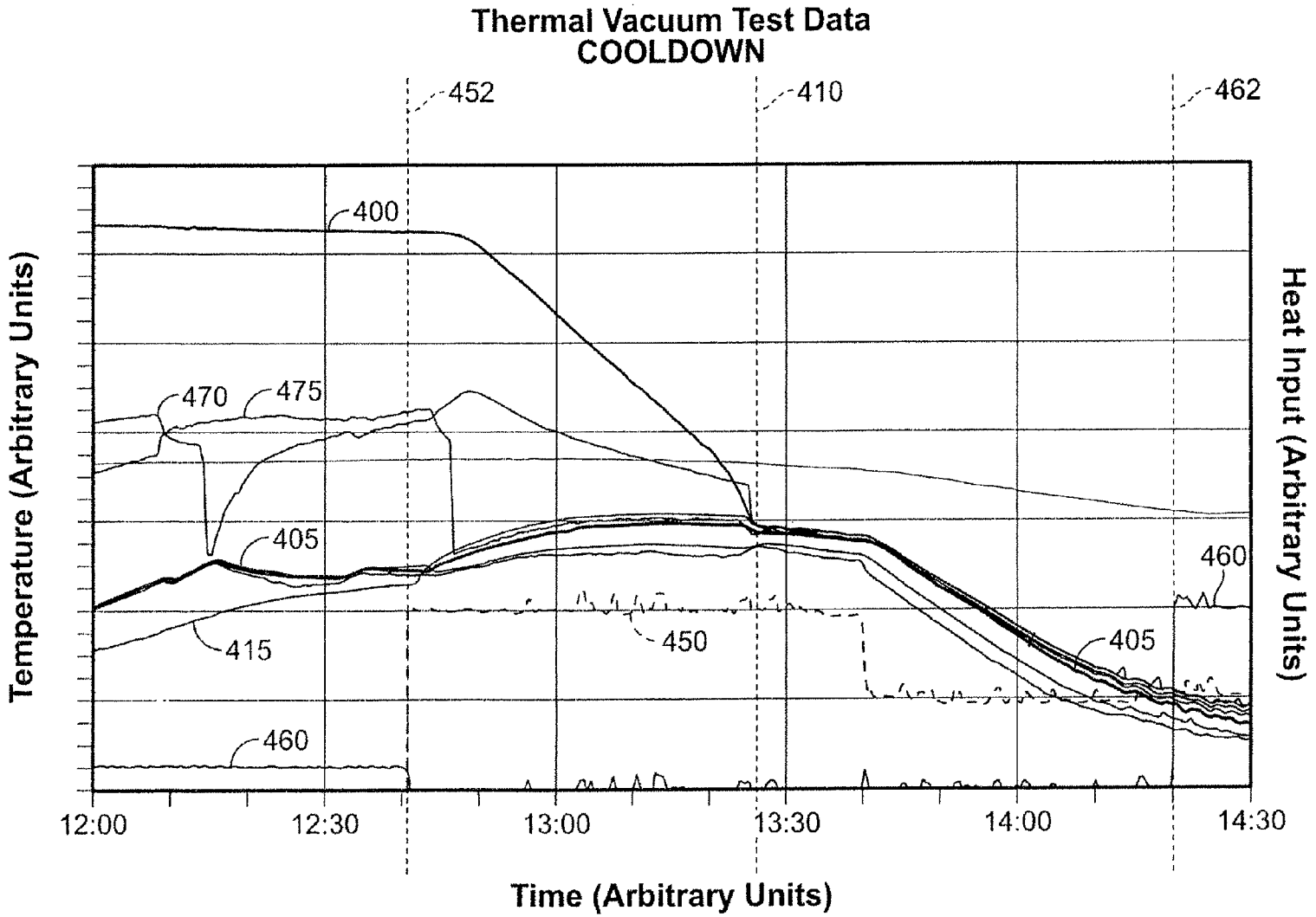
FIG. 4 is a graph showing temperature profiles of various components of the heat transport system during the process flow of FIG. 3.

As shown in FIG. 4, data from a test run is shown. In this implementation, prior to startup of the main evaporator 115 at time 410, a temperature 400 of the main evaporator 115 is significantly higher than a temperature 405 of the reservoir 155, which has been cold-biased to the set point temperature (step 305). As the priming system 110 is wetted (step 310), power level $Q_{sp}$ 450 is applied to the secondary evaporator 150 (step 315) at a time 452, causing liquid to be pumped to the main evaporator 115 (step 330), the temperature 400 of the main evaporator 115 drops until it reaches the temperature 405 of the reservoir 155 at time 410. Power input $Q_{in}$ 460 is applied to the main evaporator 115 at a time 462, when the heat transport system 100 is operating in LHP mode (step 340). As shown, power input $Q_{in}$ 460 to the main evaporator 115 is held relatively low while the main evaporator 115 is cooling down. Also shown are the temperatures 470 and 475, respectively, of the secondary fluid line 160 and the liquid line 125. After time 410, temperatures 470 and 475 track the temperature 400 of the main evaporator 115. Moreover, a temperature 415 of the secondary evaporator 150 follows closely with the temperature 405 of the reservoir 155 because of the thermal communication between the secondary evaporator 150 and the reservoir 155.

As mentioned, in one implementation, ethane may be used as the fluid in the heat transfer system 105. Although the critical temperature of ethane is 33° C., for the reasons generally described above, the heat transport system 100 can start up from a supercritical state in which the heat transport system 100 is at a temperature of 70° C. As power level $Q_{sp}$ 450 is applied to the secondary evaporator 150, the temperatures of the condenser 120 and the reservoir 155 drop rapidly (between times 452 and 410). A trim heater can be used to control the temperature of the reservoir 155 and thus the condenser 120 to −10° C. To startup the main evaporator 115 from the supercritical temperature of 70° C., a heat load or power input $Q_{sp}$ of 10 W is applied to the secondary evaporator 150. Once the main evaporator 115 is primed, the power input from the controlled heat source $Q_{sp}$ 151 to the secondary evaporator 150 and the power applied to and through the trim heater both may be reduced to bring the temperature of the heat transport system 100 down to a nominal operating temperature of about −50° C. For instance, during the main mode, if a power input $Q_{in}$ of 40 W is applied to the main evaporator 115, the power input $Q_{sp}$ to the secondary evaporator 150 can be reduced to approximately 3 W while operating at −45° C. to mitigate the 3 W lost through heat conditions (as discussed above). As another example, the main evaporator 115 can operate with power input $Q_{in}$ from about 10 W to about 40 W with 5 W applied to the secondary evaporator 150 and with the temperature 405 of the reservoir 155 at approximately −45° C.

Figure 5A:
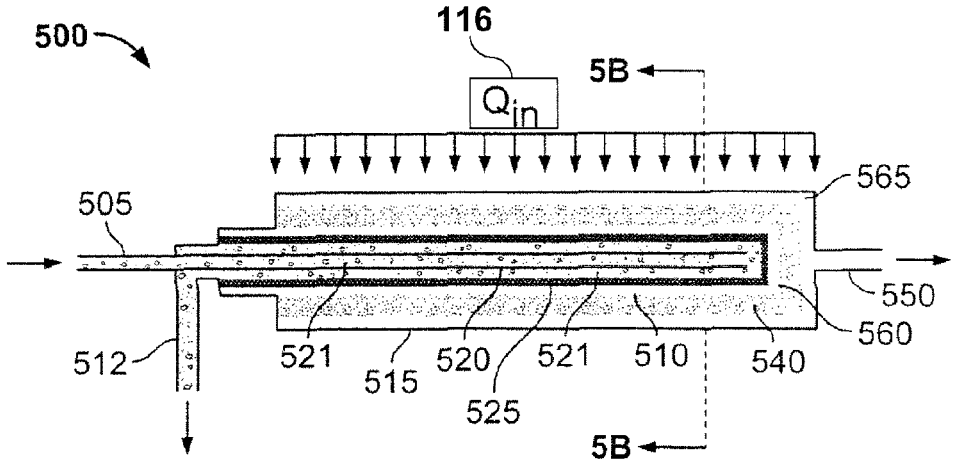
FIG. 5A is a diagram of a three-port main evaporator shown within the heat transport system of FIG. 1.
Figure 5B:
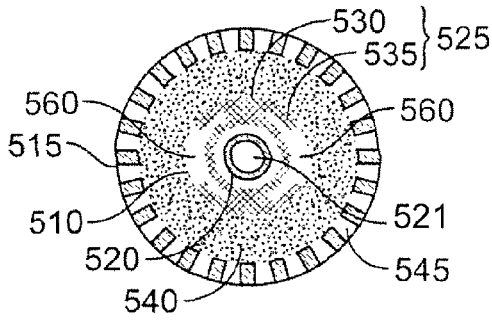
FIG. 5B is a cross-sectional view of the main evaporator taken along section line 5B-5B of FIG. 5A.

Referring to FIGS. 5A and 5B, in one implementation, the main evaporator 115 is designed as a three-port evaporator 500 (which is the design shown in FIG. 1). Generally, in the three-port evaporator 500, liquid flows into a liquid inlet 505 into a core 510, defined by a primary wick 540, and fluid from the core 510 flows from a fluid outlet 512 to a cold-biased reservoir (such as reservoir 155). The fluid and the core 510 are housed within a container 515 made of, for example, aluminum. In particular, fluid flowing from the liquid inlet 505 into the core 510 flows through a bayonet tube 520, into a liquid passage 521 that flows through and around the bayonet tube 520. Fluid can flow through a secondary wick 525 (such as secondary wick 145 of main evaporator 115) made of a wick material 530 and an annular artery 535. The wick material 530 separates the annular artery 535 from a first vapor passage 560. As power from the heat source $Q_{in}$ 116 is applied to the evaporator 500, liquid from the core 510 enters a primary wick 540 and evaporates, forming vapor that is free to flow along a second vapor passage 565 that includes one or more vapor grooves 545 and out a vapor outlet 550 into the vapor line 130 (FIG. 1). Vapor bubbles that form within first vapor passage 560 of the core 510 are swept out of the core 510 through the first vapor passage 560 and into the fluid outlet 512. As discussed above, vapor bubbles within the first vapor passage 560 may pass through the secondary wick 525 if the pore size of the secondary wick 525 is large enough to accommodate the vapor bubbles. Alternatively, or additionally, vapor bubbles within the first vapor passage 560 may pass through an opening of the secondary wick 525 formed at any suitable location along the secondary wick 525 to enter the liquid passage 521 or the fluid outlet 512.

Figure 6:
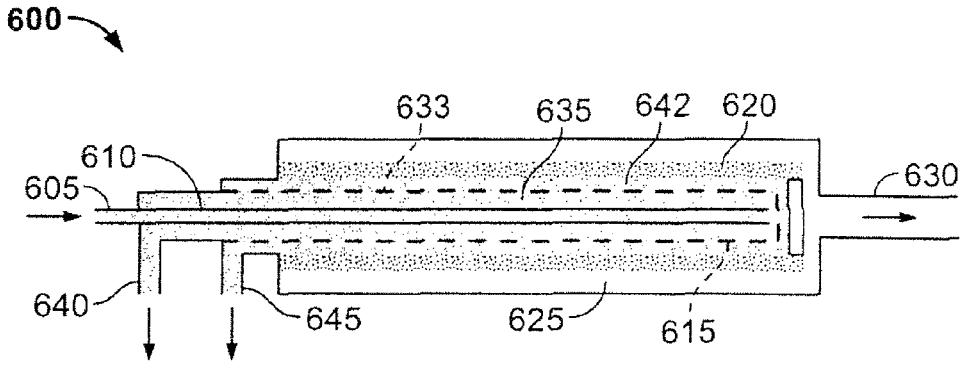
FIG. 6 is a diagram of a four-port main evaporator that can be integrated into a heat transport system illustrated by FIG. 1.

Referring to FIG. 6, in another implementation, the main evaporator 115 is designed as a four-port evaporator 600, which is a design described in U.S. application Ser. No. 09/896,561, filed Jun. 29, 2001, now U.S. Pat. No. 6,889,754, issued May 10, 2005. Briefly, and with emphasis on aspects that differ from the three-port evaporator configuration, liquid flows into the evaporator 600 through a fluid inlet 605, through a bayonet 610, and into a core 615. The liquid within the core 615 enters a primary wick 620 and evaporates, forming vapor that is free to flow along vapor grooves 625 and out a vapor outlet 630 into the vapor line 130. A secondary wick 633 within the core 615 separates liquid within the core from vapor or bubbles in the core (that are produced when liquid in the core 615 heats). The liquid carrying bubbles formed within a first fluid passage 635 inside the secondary wick 633 flows out of a fluid outlet 640 and the vapor or bubbles formed within a vapor passage 642 positioned between the secondary wick 633 and the primary wick 620 flow out of a vapor outlet 645.

Figure 7:
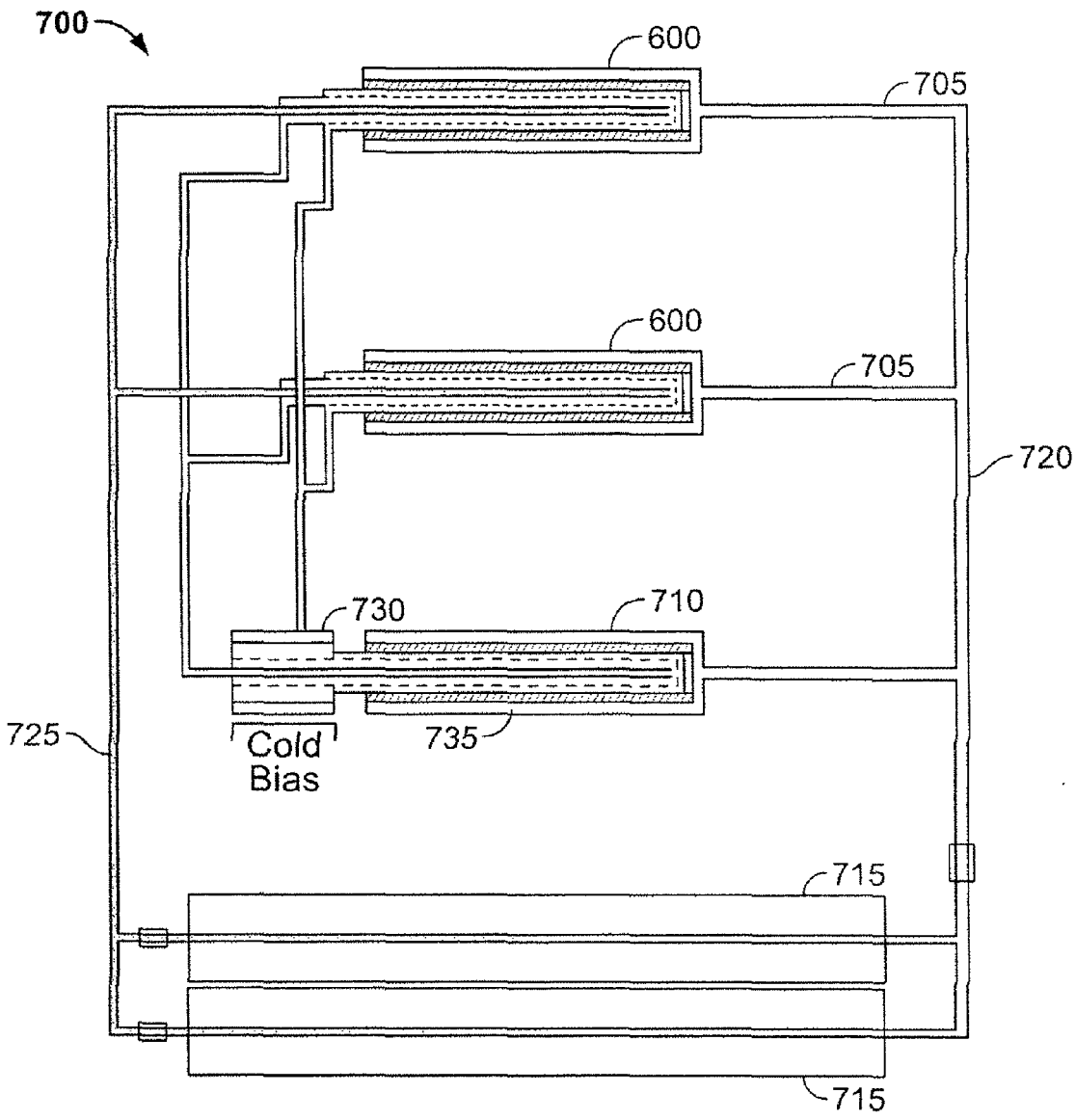
FIG. 7 is a schematic diagram of an implementation of a heat transport system.

Referring to FIG. 7, a heat transport system 700 is shown in which the main evaporator is a four-port evaporator, such as that illustrated in FIG. 6. The system 700 includes one or more heat transfer systems 705 and a priming system 710 configured to convert fluid within the heat transfer systems 705 into a liquid to prime the heat transfer systems 705. The four-port evaporators 600 are coupled to one or more condensers 715 by a vapor line 720 and a fluid line 725. The priming system 710 includes a cold-biased reservoir 730 hydraulically and thermally connected to a priming evaporator 735.

Whether using a three-port or four-port evaporator design, design considerations of heat transport systems such as the heat transport systems 100 and 700 may include various advantageous features. For example, with specific reference to elements of the heat transport system 100 (although similar comments may generally apply to the heat transport system 700 of FIG. 7, with reference to the corresponding elements as shown therein), such advantages may include startup of the main evaporator 115 from a supercritical state, management of parasitic heat leaks, heat conduction across the primary wick 140, cold biasing of the cold reservoir 155, and pressure containment at ambient temperatures that are greater than the critical temperature of the working fluid within the heat transfer system 105. To accommodate these design considerations, the body or container (such as container 515) of the main evaporator 115 or secondary evaporator 150 can be made of extruded 6063 aluminum and the primary wicks 140 and/or 190 can be made of a fine-pored wick. In one implementation, the outer diameter of the main evaporator 115 or secondary evaporator 150 is approximately 0.625 inch and the length of the container is approximately 6 inches. The reservoir 155 may be cold-biased to an end panel of the heat sink 165 using the aluminum shunt 170. Furthermore, a heater (such as a KAPTON® heater) can be attached at a side of the reservoir 155.

In one implementation, the vapor line 130 is made with smooth-walled stainless steel tubing having an outer diameter (OD) of 3/16" and the liquid line 125 and the secondary fluid line 160 are made of smooth-walled stainless steel tubing having an OD of 1/8". The lines 125, 130, 160 may be bent in a serpentine route and plated with gold to minimize parasitic heat gains. Additionally, the lines 125, 130, 160 may be enclosed in a stainless steel box with heaters to simulate a particular environment during testing. The stainless steel box can be insulated with multi-layer insulation (MLI) to minimize heat leaks through panels of the heat sink 165.

In one implementation, the condenser 122 and the secondary fluid line 160 are made of tubing having an OD of 0.25 inch. The tubing is bonded to the panels of the heat sink 165 using, for example, epoxy. Each panel of the heat sink 165 is an 8×19 inch direct condensation, aluminum radiator that uses a 1/16-inch thick face sheet. KAPTON® heaters can be attached to the panels of the heat sink 165, near the condenser 120 to prevent inadvertent freezing of the working fluid. During operation, temperature sensors such as thermocouples can be used to monitor temperatures throughout the heat transport system 100.

The heat transport system 100 may be implemented in any circumstances where the critical temperature of the working fluid of the heat transfer system 105 is below the ambient temperature at which the heat transport system 100 is operating. The heat transport system 100 can be used to cool down components that require cryogenic cooling. Referring to FIGS. 8A-8D, the heat transport system 100 may be implemented in a miniaturized cryogenic system 800. In the miniaturized system 800, the lines 125, 130, 160 are made of flexible material to permit coil configurations 805, which save space. The miniaturized system 800 can operate at −238° C. using neon fluid. Power input $Q_{in}$ 816 is approximately 0.3 to 2.5 W. The miniaturized system 800 thermally couples a cryogenic component (or heat source that requires cryogenic cooling, for example, $Q_{in}$ 816) to a cryogenic cooling source such as a cryocooler 810 coupled to cool the condensers 120, 122.

The miniaturized system 800 reduces mass, increases flexibility, and provides thermal switching capability when compared with traditional thermally switchable vibration-isolated systems. Traditional thermally switchable, vibration-isolated systems require two flexible conductive links (FCLs), a cryogenic thermal switch (CTSW), and a conduction bar (CB) that form a loop to transfer heat from the cryogenic component to the cryogenic cooling source. In the miniaturized system 800, thermal performance is enhanced because the number of mechanical interfaces is reduced. Heat conditions at mechanical interfaces account for a large percentage of heat gains within traditional thermally switchable, vibration-isolated systems. The CB and two FCLs are replaced with the low-mass, flexible, thin-walled tubing used for the coil configurations 805 of the miniaturized system 800.

Moreover, the miniaturized system 800 can function in a wide range of heat transport distances, which permits a configuration in which the cooling source (such as the cryocooler 810) is located remotely from the cryogenic component $Q_{in}$ 816. The coil configurations 805 have a low mass and low surface area, thus reducing parasitic heat gains through the lines 125 and 160. The configuration of the cooling source 810 within the miniaturized system 800 facilitates integration and packaging of the miniaturized system 800 and reduces vibrations on the cooling source 810, which becomes particularly important in infrared sensor applications. In one implementation, the miniaturized system 800 was tested using neon, operating at 25 K to 40 K.

Figure 9A:
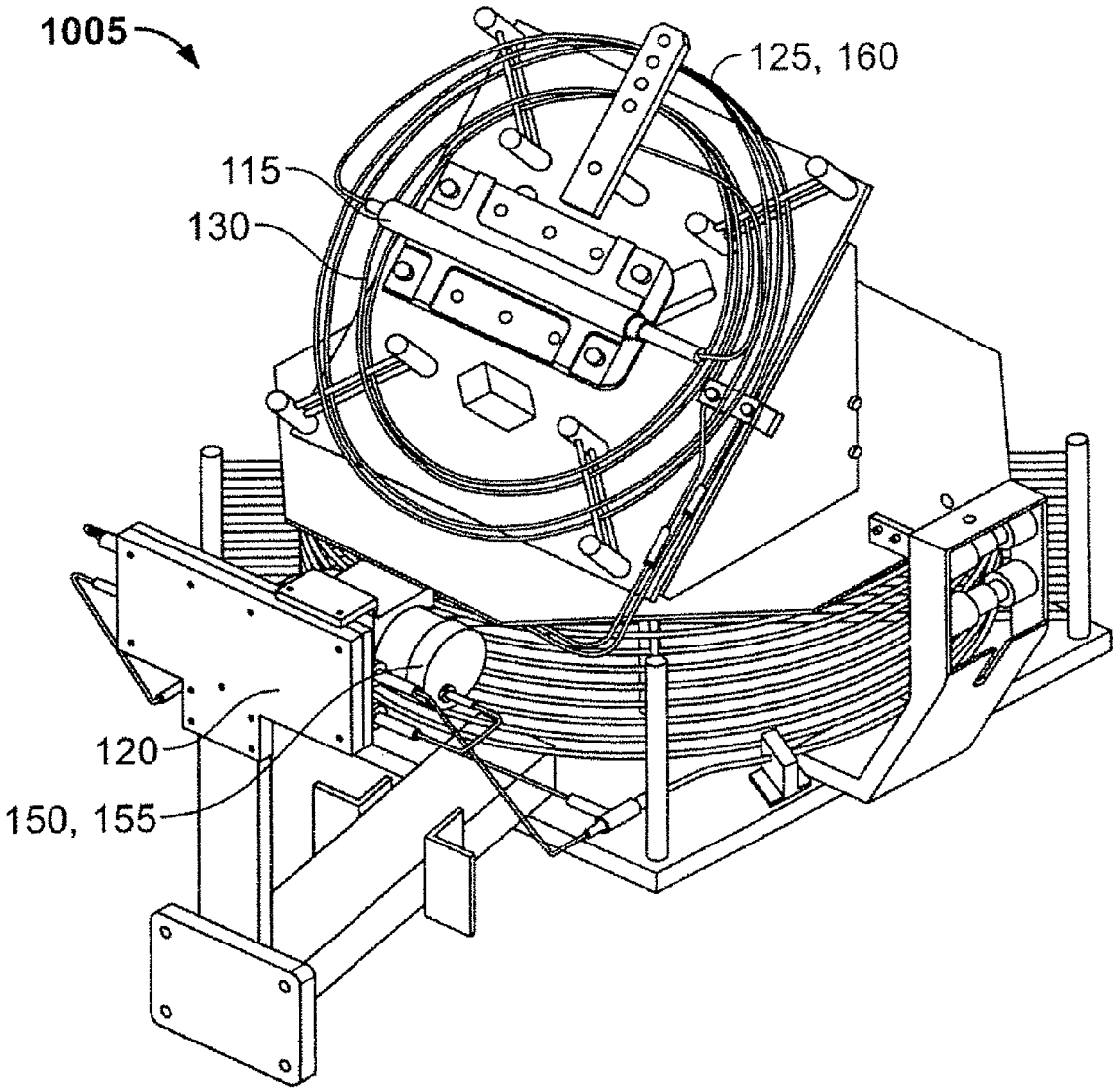
Figure 9B:
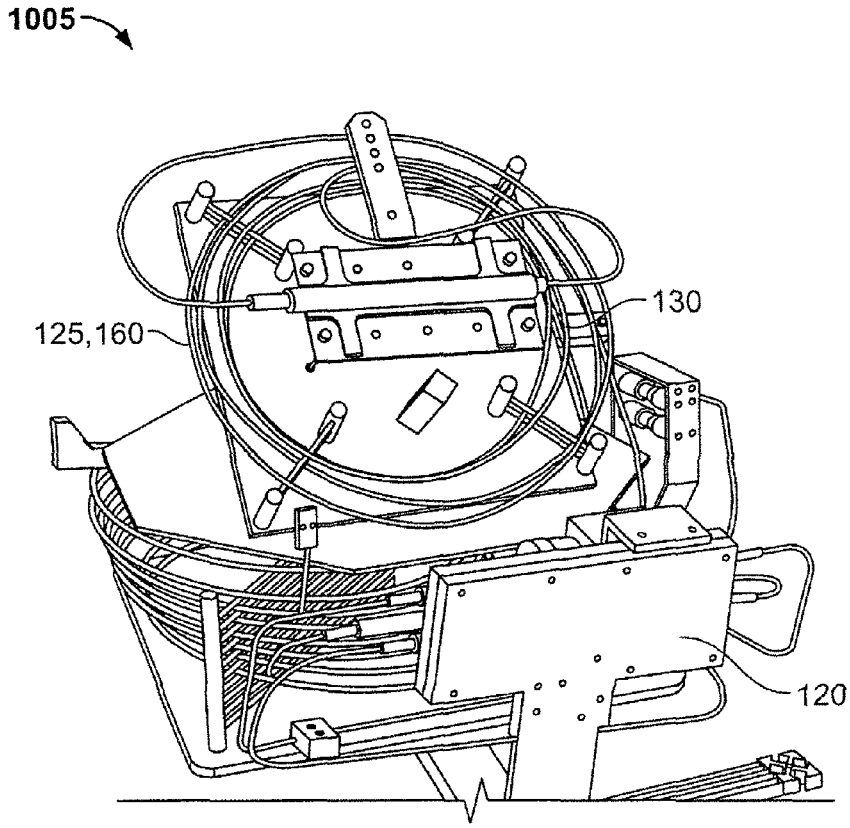
Figure 9C:
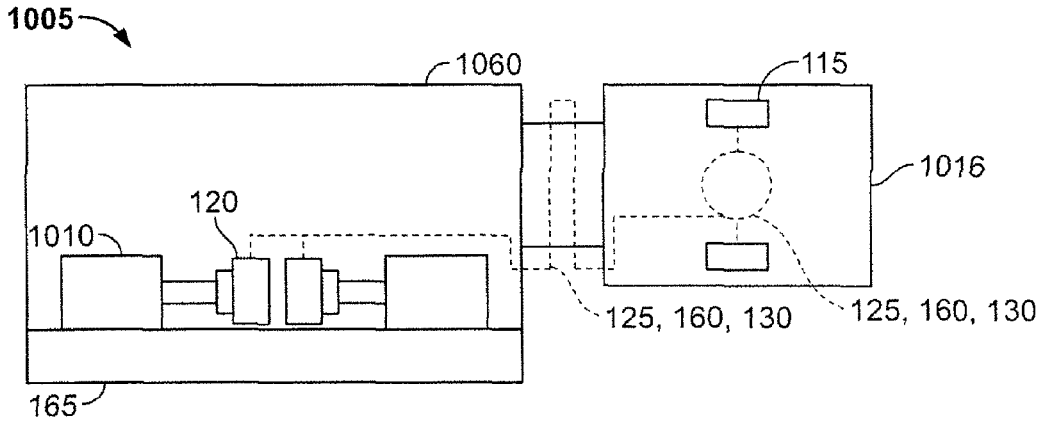

Referring to FIGS. 9A-9C, the heat transport system 100 may be implemented in an adjustable mounted or gimbaled system 1005 in which the main evaporator 115 and a portion of the lines 125, 160, and 130 are mounted to rotate about an elevation axis within a range of ±45° and a portion of the lines 125, 160, and 130 are mounted to rotate about an azimuth axis within a range of ±220°. The lines 125, 160, 130 are formed from thin-walled tubing and are coiled around each axis of rotation. The system 1005 thermally couples a cryogenic component (or heat source that requires cryogenic cooling), such as a sensor 1016 of a cryogenic telescope to a cryogenic cooling source 1010, such as a cryocooler coupled to cool the condensers 120, 122. The cooling source 1010 is located at a stationary spacecraft 1060, thus reducing mass at the cryogenic telescope. Motor torque for controlling rotation of the lines 125, 160, 130, power requirements of the system 1005, control requirements for the spacecraft 1060, and pointing accuracy for the sensor 1016 are improved. The cooling source 1010 and the radiator or heat sink 165 can be moved from the sensor 1016, reducing vibration within the sensor 1016. In one implementation, the system 1005 was tested to operate within the range of 70 to 115 K when the working fluid is nitrogen.

The heat transfer system 105 may be used in medical applications, or in applications where equipment must be cooled to below-ambient temperatures. As another example, the heat transfer system 105 may be used to cool an infrared (IR) sensor that operates at cryogenic temperatures to reduce ambient noise. The heat transfer system 105 may be used to cool a vending machine, which often houses items that preferably are chilled to sub-ambient temperatures. The heat transfer system 105 may be used to cool components such as a display or a hard drive of a computer, such as a laptop computer, handheld computer, or a desktop computer. The heat transfer system 105 can be used to cool one or more components in a transportation device such as an automobile or an airplane.

Other implementations are within the scope of the following claims. For example, the condenser 120 and heat sink 165 can be designed as an integral system, such as, for example, a radiator. Similarly, the secondary condenser 122 and heat sink 165 can be formed from a radiator. The heat sink 165 can be a passive heat sink (such as a radiator) or a cryocooler that actively cools the condensers 120, 122.

In another implementation, the temperature of the reservoir 155 is controlled using a heater. In a further implementation, the reservoir 155 is heated using parasitic heat. In another implementation, a coaxial ring of insulation is formed and placed between the liquid line 125 and the secondary fluid line 160, which surrounds the insulation ring.

Figure 10:
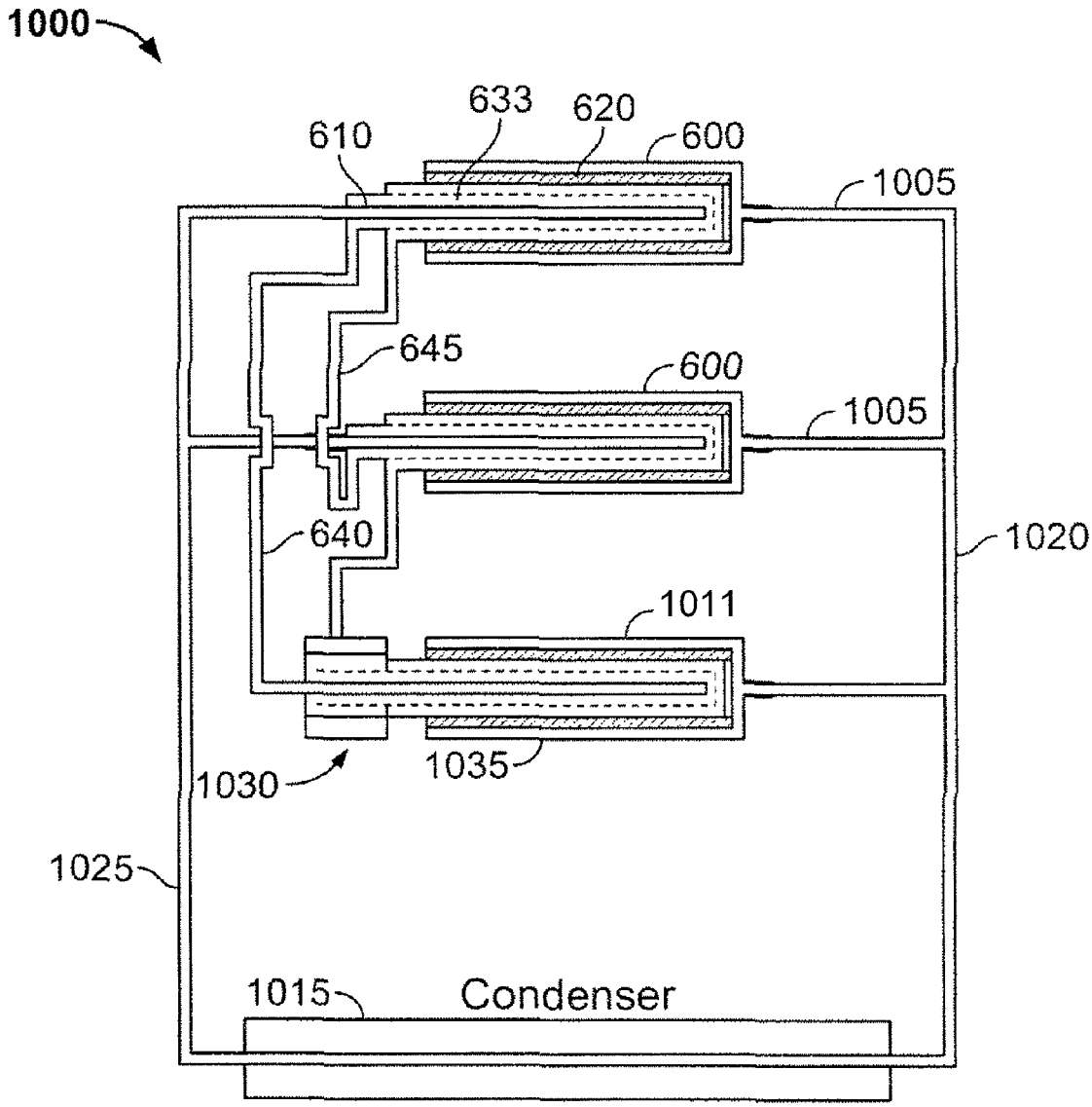
FIG. 10 is a schematic diagram of another implementation of a heat transport system.

FIG. 10 is a schematic diagram of an implementation of a heat transport system 1000. In FIG. 10, four-port evaporators 600 are arranged in a serial orientation.

More particularly, the heat transport system 1000 includes multiple heat transfer systems 1005 and a priming system 1011 configured to convert fluid from within the heat transfer systems 1005 into a liquid capable of priming the heat transfer systems 1005. The heat transfer systems 1005 each include four-port evaporators 600 that are coupled to one or more condensers 1015 by a vapor line 1020 and a fluid line 1025. The priming system 1011 includes a cold-biased reservoir 1030 hydraulically and thermally connected to a priming evaporator 1035.

Similarly to the four-port, parallel arrangement shown in FIG. 7, and in accordance with the general principles associated with an operation of the heat transport system 100 described above with respect to FIG. 1, the heat transport system 1000 is capable of starting the main evaporators 600 from a supercritical state, managing parasitic heat leaks, sweeping excess vapor and non-condensable gas bubbles (NCG) from the cores of the main evaporators 600, and various other features and advantages described herein.

Moreover, as illustrated by FIGS. 7 and 10, various implementations of heat transport systems may be used in many different operating environments, providing flexibility and a wide scope of use to designers of heat transport systems. For example, arrangements may be optimized to account for, for example, locations and types of heat sources, heat load sharing between the evaporators 600, a type of fluid used in the system(s), and various other operating parameters. Of course, it should be understood that the parallel and serial evaporator configurations of FIGS. 7 and 10 also may be implemented using three-port evaporators, such as, for example, the three-port evaporator 500 of FIGS. 5A and 5B.

Figure 11:
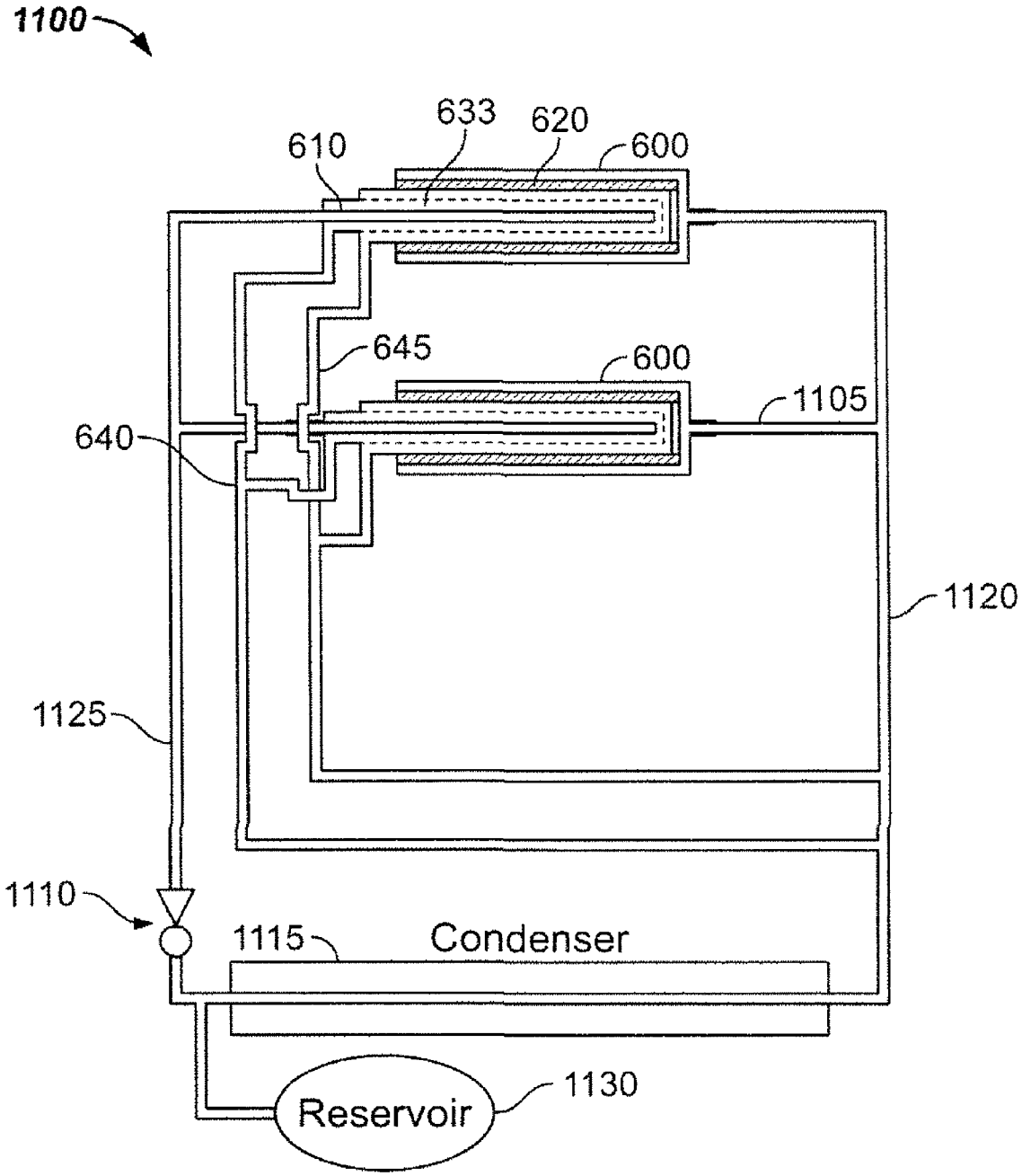
FIG. 11 is a schematic diagram of an implementation of an actively pumped heat transport system.

FIG. 11 is a schematic diagram of an implementation of an actively pumped heat transport system 1100. In FIG. 11, active loop pumping is enabled for the purpose of, for example, supporting improved waste heat rejection and heat transport capability when compared to heat transport systems that rely solely on passive (e.g., capillary) pumping.

More particularly, the actively pumped heat transport system 1100 includes multiple heat transfer systems 1105, having evaporators 600, and a mechanical pump 1110 that is arranged in series between a condenser 1115 (and a vapor line 1120 feeding the condenser 1115) and the evaporators 600, along a liquid line 1125. A reservoir 1130 is disposed between the mechanical pump 1110 and the condenser 1115, where the reservoir 1130 may be used for, for example, managing excess fluid flow, fine temperature control through cold-biasing, and other features and uses as described herein and as are known.

The actively pumped heat transport system 1100 including the mechanical pump 1110 shares certain features and advantages with the passive heat transport systems described above with respect to FIGS. 1-10. For example, the heat transport system 1100 includes a primary loop including the vapor line 1120 and the liquid line 1125, as well as secondary loop(s) defined by the secondary liquid flow channel 640 and the secondary vapor channel 645 (where it should be understood that the channels 640 and 645 may be replaced with the secondary fluid line 160 of FIG. 1 in a system using the three-port evaporator 500).

The mechanical pump 1110 thus provides a source of pumping power for moving fluid through the primary loop and/or the secondary loop of the heat transport system 1100. This pumping power may be used during various operations of the heat transport system 1100, and may be in addition to, or in the alternative to, other sources of pumping power.

For example, the pumping power provided by the mechanical pump 1110 may be used to provide liquid to the evaporators 600 during a start-up operation of the evaporators 600, perhaps in conjunction with a separate priming system. Such a priming system may include, for example, the priming system 110 of FIG. 1, or some other, conventional priming system (not shown).

The mechanical pump 1110 also may be used during steady-state operation of the heat transport system 1100, either continuously or intermittently, as needed to maintain a desired operational state of the heat transport system 1100. For example, the mechanical pump 1110 may be activated during start-up of the heat transport system 1100, and then may be bypassed or otherwise de-activated during steady-state operation of the heat transport system 1100, unless and until a secondary pumping source (e.g., passive pumping supplied by capillary pressure) is insufficient to provide adequate heat transfer. In this sense, the heat transport system 1100 may be considered a dual-pumping system, in which mechanical pumping, capillary pumping, or some combination of both, is available on an as-needed basis to an operator or designer of the heat transport system 1100. In particular, for instance, when the heat transport system 1100 is used to provide heat transfer over relatively large distances (e.g., 10 meters or more), the mechanical pump 1110 may be required to be used continuously to ensure adequate pumping power.

As a final example, and as discussed in more detail below, pumping power of the mechanical pump 1110 also may be used to ensure sweeping or venting of vapor bubbles from the cores of the evaporators 600. As such, a use or extent of the pumping power of the mechanical pump 1110 may be dependent on the extent to which such vapor bubbles exist (or are thought to exist) within the evaporator cores or, similarly, may be dependent on the extent to which conditions for creating such vapor bubbles within the evaporator cores exist within and around the heat transport system 1100.

As just referenced, and as described above in detail, the construction of three- and/or four-port evaporators permit control and management of liquid and vapor phases within the evaporator core(s). Specifically, for example, fluid within the cores 615 of evaporators 600 that includes a combination of liquid and vapor bubbles may be swept out of the cores 615 for discharge into the secondary liquid channels 640 and vapor channels 645 (or into the mixed secondary fluid line 160 in a three-port evaporator configuration).

As also described above, such mixed-phase fluid within the core 615 may result from various causes. For example, the mixed-phase fluid may result from heat conduction across the primary wick 620 and/or parasitic heat gains through the liquid line 1125 (e.g., when routing the liquid line through a "hot" environment). Whatever the cause of the mixed-phase flow, the heat transport system 1100 (using the mechanical pump 1110), and the systems described above (using the priming or secondary evaporators 150/710/1011 and associated reservoirs), are operable to provide excess liquid to the evaporators 600, above and beyond the minimum needed to maintain operation of the heat transport system (e.g., an amount needed to maintain saturation of the wicks and associated capillary pumping).

As a result, the heat transport system 1100, and the systems described above, are able to use this excess liquid to vent or sweep the gaseous portion of the mixed-phase flow from the evaporators 600, using the secondary flow loops that include the secondary liquid/vapor channels 640/645 or the mixed secondary fluid line 160. In this way, excess vapor enters the secondary loop either through the secondary wick 635 (if feasible for a given pore size of the secondary wick 635), or through an opening at an end of the secondary wick near an outlet port for the secondary loop(s), and is returned to the condenser 1115 for condensation and subsequent return through the liquid line 1125 and/or to the reservoir 1130.

In one implementation, an amount of excess liquid provided to the cores of the evaporators 600 is optimized. In this implementation, the amount of excess liquid is sufficient to sweep all of the evaporator cores present in the system, but not substantially more than this amount, since excess fluid in the heat transport system 1100 may affect performance and reliability of the heat transport system 1100. However, sweeping all of the evaporators 600 may be problematic, particularly, for example, when the evaporators 600 are not powered equally or, in the limiting case, where one of the evaporators 600 receives no heat (or actually acts as a condenser).

One technique for optimizing an amount of excess fluid flow to the evaporators 600 includes an appropriate selection of line diameters of the evaporator wicks, and/or for the liquid line 1125 or the vapor line 1120. By selecting these line diameters appropriately, an amount of excess fluid beyond that required for operation of the evaporators 600 may be reduced or minimized, while still ensuring that the amount of excess fluid is sufficient to completely sweep or vent all of the evaporators 600.

More particularly, in an implementation such as the one just described, such line sizing may be a factor in determining an efficiency of the sweeping of the evaporators 600. In the case of FIG. 11, this sweeping efficiency may determine how much more liquid must be supplied to the evaporators 600 through the liquid line 1125 than what is required to satisfy the heat load(s) of the evaporators 600. Similarly, in the case of FIG. 1 or FIG. 7, the sweeping efficiency may determine how much power must be applied to the secondary evaporator in excess of what is required to satisfy the heat load of the main evaporators 115 or 600, respectively.

One parameter for describing the appropriate sizing criteria includes a ratio of the flow resistance of the sweepage line(s) 640/645 (or, in FIG. 1, the mixed secondary fluid line 160) to a sum of the resistances of the liquid line 1125 (125 in FIG. 1) outside of the evaporator 600 and the liquid flow passage in the evaporator core 615 (135 in FIG. 1). In general, a relatively large value of this ratio is preferred, and serves to decrease a sweepage power required to completely sweep all evaporator cores.

With such complete sweepage being provided, the heat transport system 1100 may use a narrow-diameter, small-pore, metal wick (e.g., 1 micron pore metal wick), which provides high thermal conductivity and increased pumping capability, relative to the polyethylene wicks that often are used in conventional heat transport systems. Such polyethylene wicks may be used despite their reduced pumping capacity, in part due to their relatively wide diameter and large pore size, which tends to reduce their thermal conductivity and, therefore, tends to reduce a presence of vapor within the liquid line 1125 and liquid core 615.

In other words, since the structure and function of the heat transport system 1100 enable venting or sweeping of such undesirable vapor from the core 615, the heat transport system 1100 may not be required to resort to disadvantageous measures to avoid the presence of this vapor in the first place. As a result, the system 1100 may enjoy the advantages of narrow-diameter, small-pore, metal wicks, and, in particular, increased pumping against gravity by a factor of ten, relative to polyethylene wicks, for example. Similarly, the heat transport system 1100 may not require subcooled liquid to be returned to the core 615, such that the liquid line 1125 may be routed through hotter environments than are feasible with conventional systems that do not offer vapor sweepage, as it is described herein.

Accordingly, the heat transport system 1100 may provide many advantageous features for the transport and disposal of heat. For example, in addition or as an alternative to one or more of the features just described, the mechanical pump 1110 of the heat transport system 1100 may provide increased flow, increased flow controllability, and increased waste heat transportation and rejection, relative to passive systems (for example, heat transport may occur on the order of 50 kW or more, over a distance of 10 meters or more). As another example, the mechanically pumped heat transport system 1100 may greatly reduce temperature gradients across phased array antennas that may include thousands of elements arranged in complex arrays, thereby reducing an overall size of such arrays and reducing or eliminating the need for separate heat pipes to maintain acceptable element temperatures within the arrays.

The heat transport system 1100 offers one or more of the following or other advantages over conventional actively pumped systems as well, including those that have been deployed, for example, in geosynchronous communication satellites. For instance, the two-phase nature of the heat transport system 1100 is beneficial to heat transfer at the thermal interfaces, and reduces required pumping power. Additionally, the sweepage of excess vapor and its complete condensation within the condenser 1115 may reduce an amount of mixed fluid (i.e., two-phase) flow experience by the mechanical pump 1110. As a result, a lifetime and reliability of the mechanical pump 1110 may be improved, since vapor within a liquid mechanical pump such as the mechanical pump 1110 tends to provide excessive stress within the pump.

In addition to some or all of these and other advantages, the heat transport system 1100 is compatible with a wide variety of thermal management components and features. Accordingly, FIGS. 12-16 are schematics of implementations of the heat transport system 1100 of FIG. 11 that demonstrate examples of such thermal management components and features.

Figure 12:
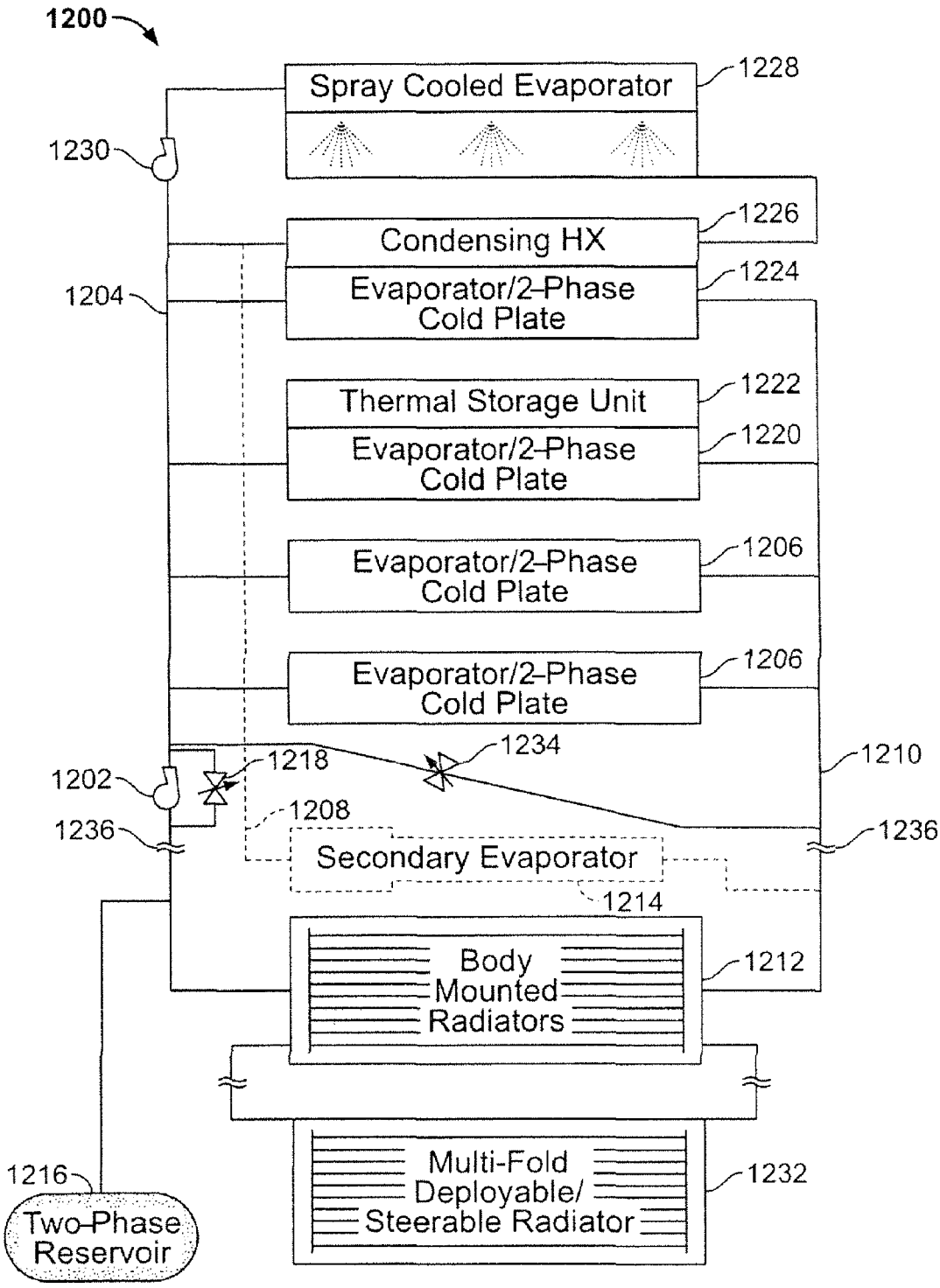
FIGS. 12-16 are schematics of implementations of the system of FIG. 11 that demonstrate various examples of thermal management components and features.

In FIG. 12, a system 1200 operates essentially as described above with respect to the heat transport system 1100. The mechanical pump 1110 is illustrated as a liquid pump 1202 that is in series with a liquid line 1204 that is connected to evaporators 1206. The evaporators 1206 vent or sweep two-phase fluid flow from their respective liquid cores through a mixed fluid line 1208, as already described. The evaporators 1206 also output vapor through a vapor line 1210 to a condenser 1212, which, in FIG. 12, includes a body-mounted radiator (discussed in more detail below).

The mixed fluid line 1208 is shown as a dashed line in FIG. 12 to indicate the variety of forms it may take within the system 1200. For example, the mixed fluid line 1208 may be implemented in a coaxial fashion with respect to the liquid flow line 1204, as described above with respect to, for example, FIG. 8C. Such an implementation assists in protecting the liquid line 1204 from parasitic heat effects that may cause vapor and/or NCG bubbles within the liquid line 1204, and allows the liquid line 1204 to be routed through relatively hot environments without experiencing parasitic heat gain.

Further, the mixed fluid line 1208 may be used in conjunction with a secondary evaporator 1214, which, when used with a (cold-biased) reservoir 1216 in one of the various manners described above, provides for advantages such as, for example, operation of the system 1200 (or the heat transport system 1100) in a passive mode, in which the mechanical pump 1202 (or 1110) is bypassed, perhaps using a pump bypass valve 1218, and the system 1200 (or 1100) relies solely on capillary pumping for fluid flow.

To the extent that the system 1200 uses fine-pore metal wicks, as described above with respect to FIG. 11, its passive pumping capacity in this mode may be improved relative to other passive, capillary-pumped loops. Although the secondary evaporator is shown only conceptually in FIGS. 12-15, its use should be apparent based on the above descriptions of secondary evaporators or priming systems 150, 710, and 1011. Moreover, a particular implementation for using such a secondary evaporator in the context of a mechanically pumped heat transfer system is discussed in detail with respect to FIG. 16.

As referred to above with respect to FIG. 11, the secondary evaporator 1214 is not required for the system 1200 to operate in passive mode. For example, in such a passive mode, a conventional priming system may be used for starting the system 1200 (e.g., for wetting the primary wicks of the evaporators 1206). Alternatively, the liquid pump 1202 may be used to prime the evaporator(s) 1206 initially for starting, and/or may be used to maintain saturation of the primary wicks of the evaporators 1206 intermittently thereafter. The choice of which startup method(s) to use, or whether or when to use the system 1200 in a passive mode at all, is, of course, dependent on various operational and environmental factors of the system 1200, such as, for example, one or more of the type of working fluid, a critical temperature of the working fluid, an ambient operating temperature of the system 1200, the amount of heat to be dissipated, and various other factors.

The above discussion of a general operation of the system 1200 included reference to the evaporators 1206, similar in structure and function to one or more of the various evaporators discussed herein, and using a cold plate as a heat transfer surface. However, it is a strength of the system 1200 that multiple types and arrangements of evaporators and heat transfer surfaces may be used.

For example, in FIG. 12 the system 1200 includes an evaporator 1220 that is interfaced with a thermal storage unit 1222. In one implementation, the thermal storage unit 1222 may be used as a heat load transformer for pulsed power applications, such as, for example, space-based laser applications. The thermal storage unit may include, for example, 250 W-hr graphite hardware and a paraffin-based, lightweight composite design.

Further in FIG. 12, the system 1200 may include an evaporator 1224 that is interfaced with a condensing heat exchanger 1226, which is used to couple a spray-cooled evaporator 1228 into the system 1200. The heat exchanger 1226 may be, for example, a high efficiency, two-phase/two-phase heat exchanger. A liquid pump 1230 is used to pump liquid from the condensing heat exchanger 1226 through the spray-cooled evaporator 1228, to thereby form a separate loop coupled to the loop(s) of a primary thermal bus of the system 1200.

In particular, such a separate loop may be used to connect the spray-cooled evaporator 1228 to the system 1200, due to the fact that a nozzle pressure drop (e.g., 0.7 bar) of the spray-cooled evaporator 1228 relative to a capillary pressure rise (e.g., 0.4 bar) in the system 1200 may make parallel arrangement of the spray-cooled evaporator 1228 difficult in some use environments. In other implementations, however, the spray-cooled evaporator 1228 may be integral to the system 1200, instead of being coupled through the condensing heat exchanger 1226.

The spray-cooled evaporator 1228 may be used for efficient thermal control of high heat flux sources. For example, 500 W/cm$^2$ has been demonstrated with a heat transport system using ammonia as the working fluid. A loop using the spray-cooled evaporator 1228 may be operated near saturation in order to maximize heat transfer.

Such a spray-cooled evaporator 1228 may be particularly useful, for example, in spacecraft thermal management. For instance, in spacecraft electronics, heat fluxes at transistor gates are approaching 1 MW/in$^2$. As component size continues to shrink and heat fluxes rise further, state-of-the-art systems may be used to offset the associated increases in local temperature drops. The significantly higher heat-transfer coefficient afforded by spray cooling, using the spray-cooled evaporator 1228, may be advantageous in this respect.

Factors to consider in using the spray-cooled evaporator 1228 include, for example, nozzle optimization and scalability of the spray-cooled evaporator 1228 to extended surface areas. In one implementation, the spray-cooled evaporator 1228 may be used for cooling laser diode applications.

In FIGS. 11 and 12, and in light of the above discussion, it should be understood that the capillary pumping developed by the evaporator wicks, as described above, may generally maintain phase separation at each heat source interface of the evaporators, and thereby assure excellent heat transfer characteristics and automatic flow control among the evaporators, even when no flow controllers are used. A pressure diagram illustrating this phenomenon is described in more detail below with respect to FIG. 25.

Also, it should be apparent from FIG. 12 and the above discussion that many variations exist with respect to a number, type, and arrangement of evaporators that may be used in the system 1200. Further examples of evaporator configurations are discussed below with respect to FIGS. 18A-18C.

Similarly, many types of condenser configurations may be used. For example, the condenser 1212 referred to above may include a body-mounted radiator, while a condenser 1232 may include a multi-fold, deployable or steerable radiator. Particularly in high-power spacecraft, these radiators may be direct condensation or may use discrete heat pipes, depending on, for example, system reliability factors and/or a mass of micro-meteoroid shielding. As just mentioned, the condenser 1232 also may be made steerable for non-geostationary applications, in order, for example, to minimize radiator backloading. Gimbaled heat transport systems used in conventional telecom satellite systems may be used to enable such steerable radiators. Further, passive two-phase loops (e.g., LHPs) also may be incorporated into two-axis gimbaled systems. Other examples of condenser configurations are discussed below with respect to FIGS. 18A-18C.

Finally, with respect to FIG. 12, a liquid bypass valve 1234 is illustrated that may be used, for example, to maintain constant pump speed operations with the liquid pump 1202, and which may improve a pump lifetime of the pump 1202. Further, flexible elements 1236 are illustrated in order to indicate that the various elements of the system 1200 may be routed over and through a wide variety of use environments.

Figure 13:
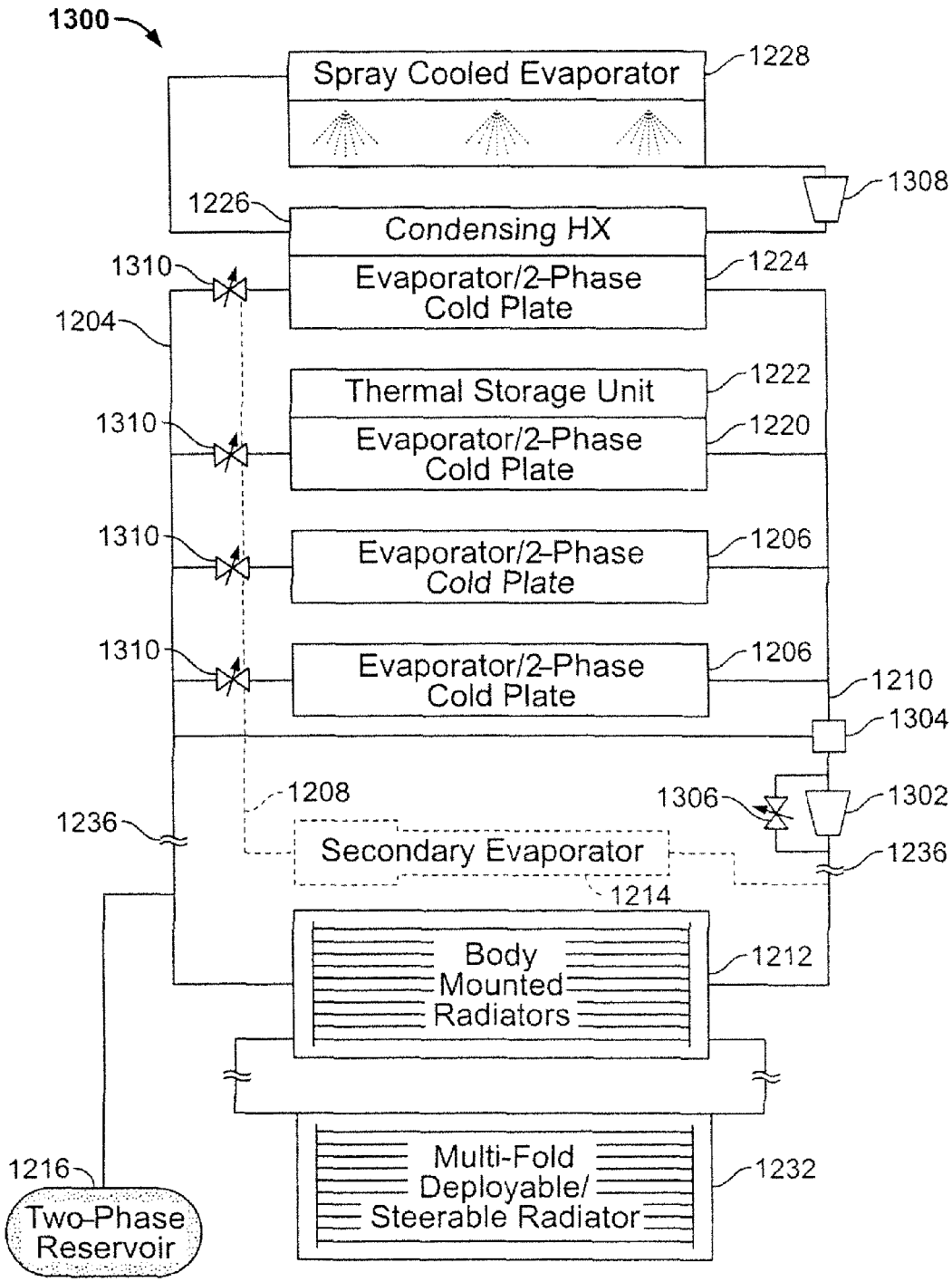

FIG. 13 is a schematic illustrating a heat transport system 1300 that shares many elements with the system 1200 of FIG. 12 (indicated in FIG. 13 by like-numbered elements). In FIG. 13, however, the mechanical pump 1110 of FIG. 11 is represented by a vapor compressor 1302, which may be a variable-speed vapor compressor. A liquid/vapor separator 1304 (or a vapor superheater (not shown)) may be used to prevent liquid from entering the compressor and, similarly to the pump bypass valve 1218 of FIG. 12, a compressor bypass valve 1306 may be used to operate the system 1300 in a passive (capillary) pumping mode.

The choice of whether to use the liquid pump 1202 or the vapor compressor 1302 is typically a design consideration. Generally, the liquid pump 1202 offers lighter weight and increased pumping power relative to the vapor compressor 1302 (due to, for example, the lower volumetric flow rate of the former). On the other hand, the vapor compressor 1302 offers heat pumping (i.e., an increased condensation temperature), which may reduce radiator heat and overall system mass and, additionally, may offer a longer operational lifetime.

The liquid pump 1202 may include, for example, a hermetically sealed, magnetically driven, centrifugal design. Other liquid pumps for space station applications, e.g., waste water and carbon dioxide, also may be used.

The vapor compressor 1302 may be a variable-speed compressor, and may include, for example, a hermetically sealed, oil-less centrifugal compressor with gas or magnetic bearings. A low-lift heat pump, which includes a similar compressor, also may be used. Further examples of specific types of pumps are provided below and, in particular, with respect to FIGS. 17A-17E.

As also illustrated in FIG. 13, a vapor compressor 1308 may be used in the loop formed by the spray-cooled evaporator 1228 and the condensing heat exchanger 1226, instead of the liquid pump 1230. The choice between the liquid pump 1230 and the vapor compressor 1308 may be driven by, for example, design choices similar to those just described.

Further in FIG. 13, flow controllers 1310 may be used to ensure a desired heat load distribution between the evaporators 1206, 1220, and 1224. For example, the flow controllers 1310 may be used to route more or less liquid to a particular evaporator, depending on, for example, an amount of heat present at that evaporator or, in the case of the evaporator 1220, an amount of heat to be stored in the thermal storage unit 1222. In order to provide equal heat load distribution, for example, feedback may be provided from an output of each of the evaporators 1206, 1220, and 1224 to the flow controllers 1310. An example of this implementation is illustrated in more detail below, with respect to FIG. 15. The flow controllers 1310 are shown in FIG. 13 as liquid flow controllers, but also may include other types of flow controllers, such as, for example, vapor flow controllers.

Figure 14:
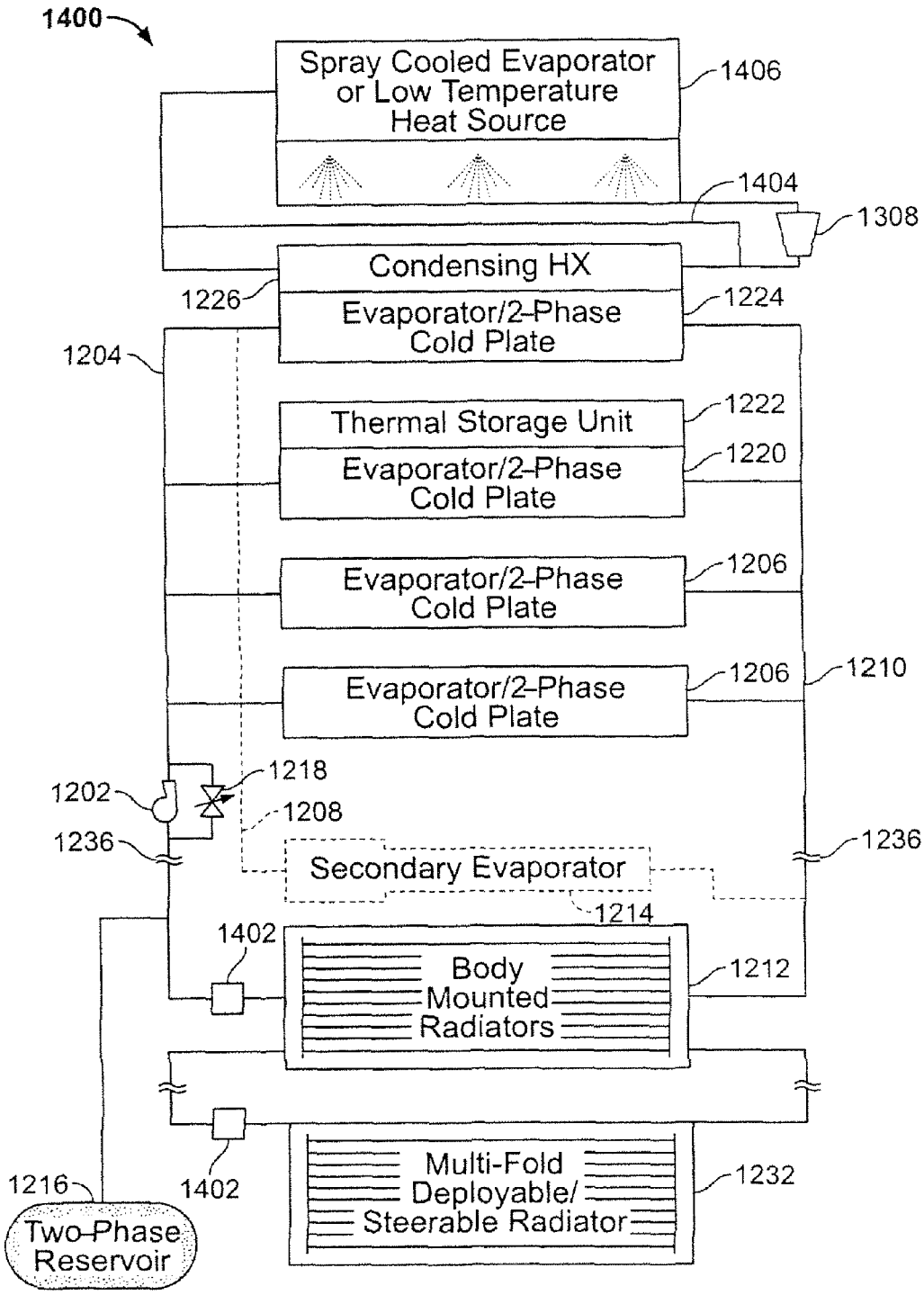

Referring to FIG. 14, an implementation of a system 1400 is shown that includes condenser capillary flow regulators 1402. The regulators 1402 are included to increase or maximize condenser efficiency, reduce or minimize condenser size, and ensure subcooled liquid return to the liquid pump 1202. The flow regulators 1402 are discussed in more detail below with respect to FIG. 19.

Also in FIG. 14, a vapor bypass line 1404 is shown in conjunction with a low temperature heat source 1406 (and/or the spray-cooled evaporator 1228). Specifically, the vapor bypass line 1404 bypasses the vapor compressor 1308 and facilitates operation of the condensing heat exchanger 1226.

Figure 15:
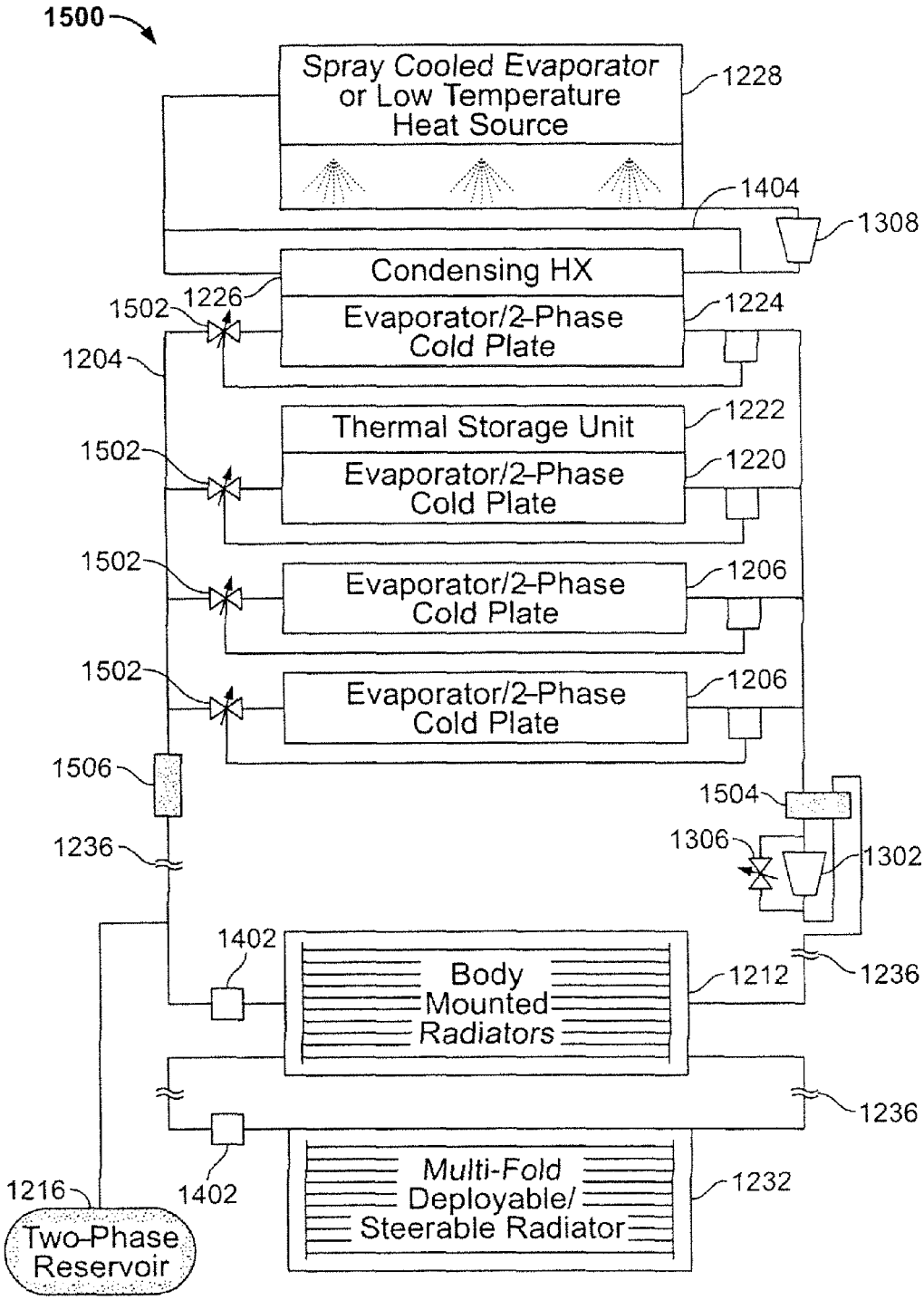

Referring to FIG. 15, an implementation 1500 is shown that includes superheat feedback flow controllers 1502 for regulating evaporator flow control. A regenerator 1504 is connected to the vapor compressor 1302, and generally is operable to reuse the latent heat in the steam that leaves the compressor 1302 to assist in operation of the compressor 1302. An expansion valve 1506 is included to meter the liquid flow that enters the evaporators from the liquid line 1204, such that the liquid flow enters the evaporators at a desired rate, e.g., a rate that matches the amount of liquid being evaporated in the evaporators.

Figure 16:
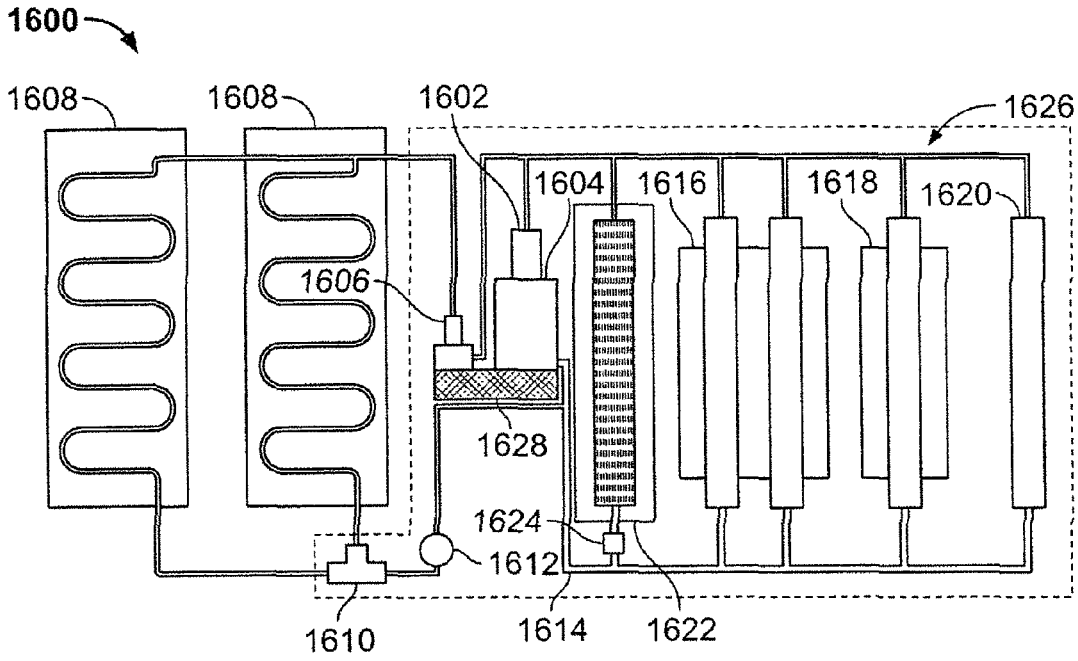

Referring to FIG. 16, an implementation of a system 1600 is shown that includes a secondary evaporator 1602, which is used similarly to the secondary evaporator 150 of FIG. 1, the secondary evaporator 710 of FIG. 7, and the secondary evaporator 1011 of FIG. 10. That is, the secondary evaporator 1602 is used as a priming evaporator for ensuring successful start-up of the system 1600, and for ensuring sufficient excess flow through the primary evaporator cores to enable venting of excess vapor and NCG bubbles therefrom, particularly during a passive (capillary) operation of the system 1600.

More specifically, as should be apparent from the above discussion, the secondary evaporator 1602 is thermally and hydraulically connected to a cold-biased reservoir 1604. As described with respect to FIG. 3, application of power (heat) to the secondary evaporator 1604 causes evaporation therefrom, which travels through a back pressure regulator (BPR) 1606 (discussed in more detail below) and is condensed within one or more condensers 1608. Flow regulators 1610 (similar to the regulators 1402 discussed above, and co-located with one another or with their respective condensers) regulate the condensed liquid flow from the condensers 1608 through a mechanical pump 1612. From there, the condensed liquid flows through an inner liquid flow line of a coaxial flow line 1614. In this way, the liquid reaches cold plate evaporator(s) 1616, as well as a thermal mass (storage unit) 1618 and a remote evaporator 1620.

Further, an isothermalized plate or structure 1622 may be included. Such a structure may be useful, for example, in settings where a constant temperature surface is desired or required, such as, for example, some laser systems. To the extent that such systems require a constant temperature surface, it may be efficient to use the (waste) heat being transported by the system 1600 to keep the structure 1622 at a constant temperature. When the structure 1622 is used, a flow regulator 1624 (perhaps similar to the regulators 1402 of FIG. 14) may be used to ensure that a proper amount of vapor from a vapor return line 1626 is provided to the structure 1622.

A liquid line heat exchanger 1628 is used to provide subcooling of the liquid before it is routed to the evaporators. Also, as just referred to, the vapor return line 1626 returns vapor to the secondary evaporator 1602 and to the BPR 1606. The BPR 1606, generally speaking, ensures that no vapor reaches the condensers unless a vapor space for all evaporators in the system is devoid of liquid. As such, heat load sharing among the many parallel (or series) evaporators may be increased. An example of the BPR 1606 is discussed in detail below with respect to FIG. 20.

FIGS. 11-16 illustrate various implementations of actively pumped thermal management systems, which include different combinations and arrangements of thermal management components. In order to further illustrate the flexibility of design and use of such thermal management systems, additional examples of such thermal components and their uses are provided below with respect to FIGS. 17-25. It should be understood that such thermal components, and others, may be used in conjunction with some or all of the implementations of FIGS. 11-16, or in other implementations.

Figure 17A:
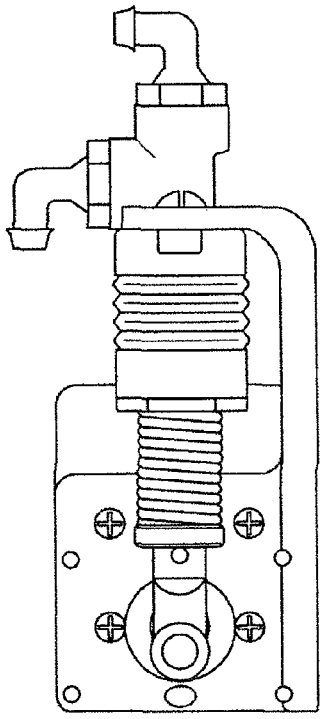
FIGS. 17A-17E are examples of mechanical pumps that may be used in the systems of FIGS. 11-16.
Figure 17B:
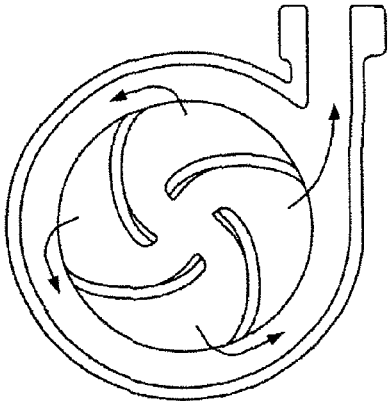
Figure 17C:
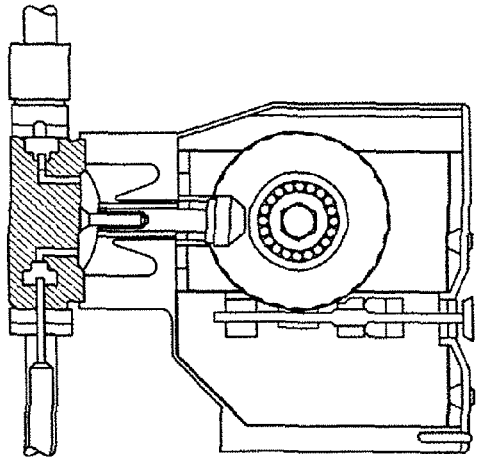
Figure 17D:
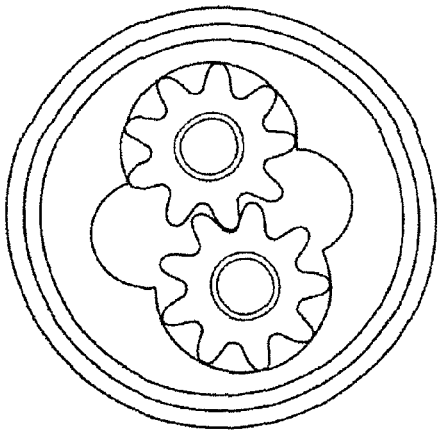
Figure 17E:
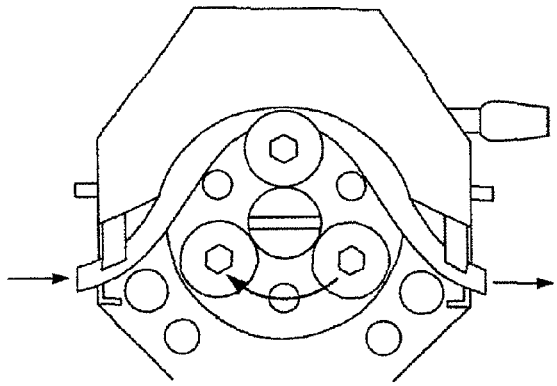

FIGS. 17A-17E are examples of mechanical pumps that may be used in the systems of FIGS. 11-16. Specifically, FIG. 17A illustrates a bellows pump, while FIG. 17B illustrates a centrifugal pump. FIG. 17C illustrates a diaphragm pump, and FIG. 17D illustrates a gear pump. Finally, FIG. 17E illustrates a peristaltic pump. It should be understood that the illustrated pumps are merely examples of known pumps that may be used in an actively pumped thermal management system, and other types of pumps also may be used.

Figure 18A:
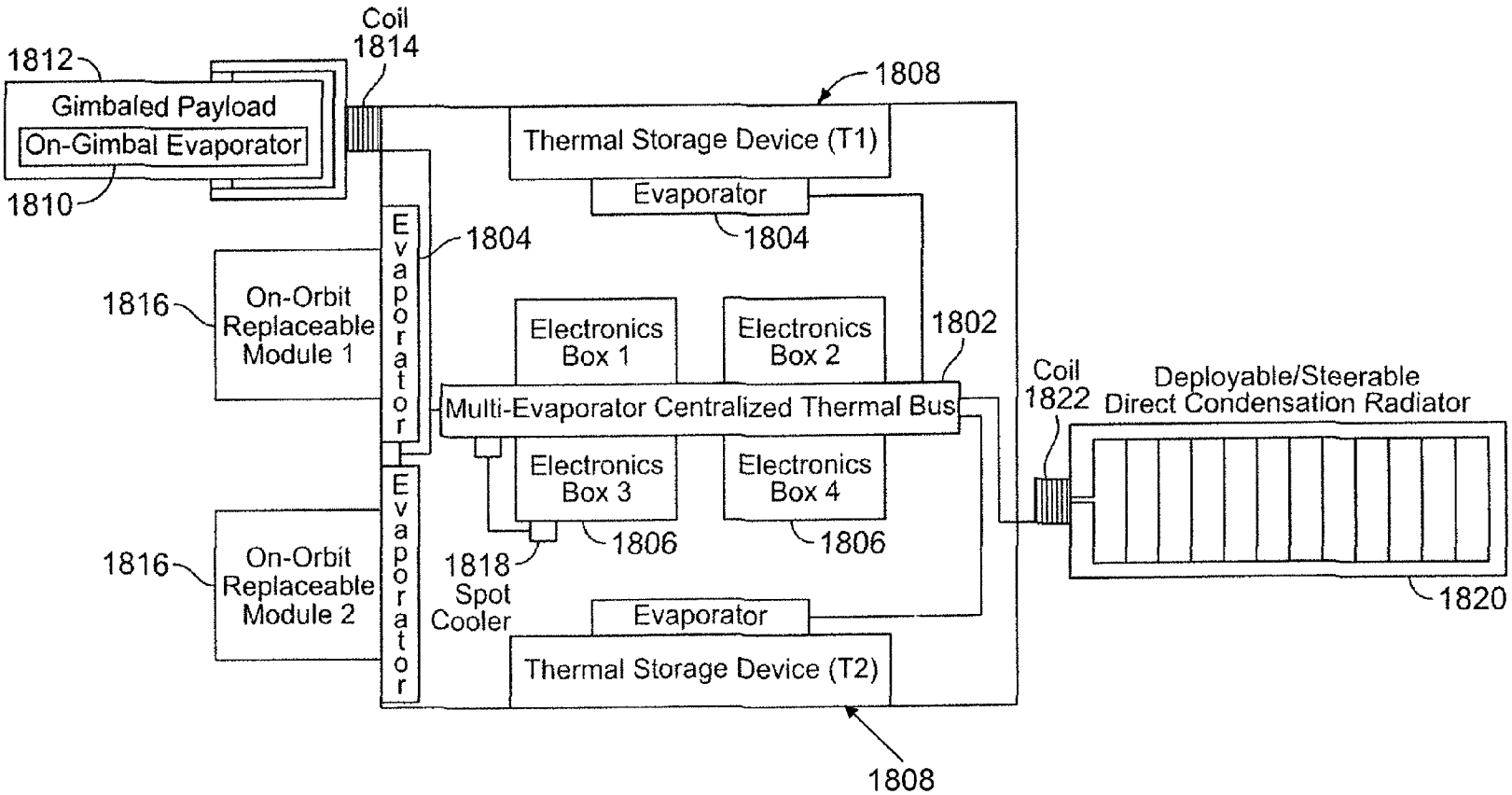
FIGS. 18A-18C illustrate examples of different evaporator and condenser architectures for use with the systems of FIGS. 11-16.
Figure 18B:
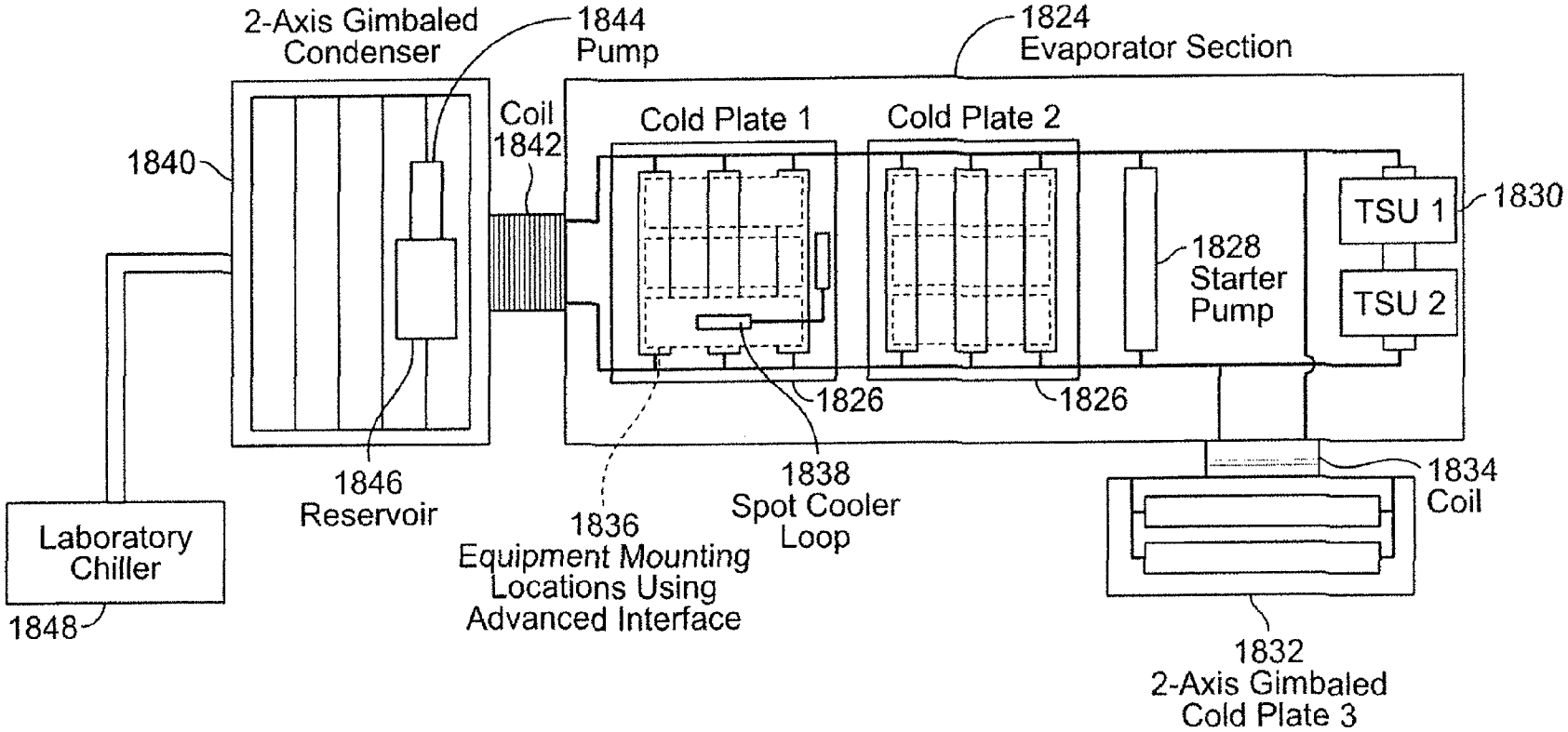
Figure 18C:
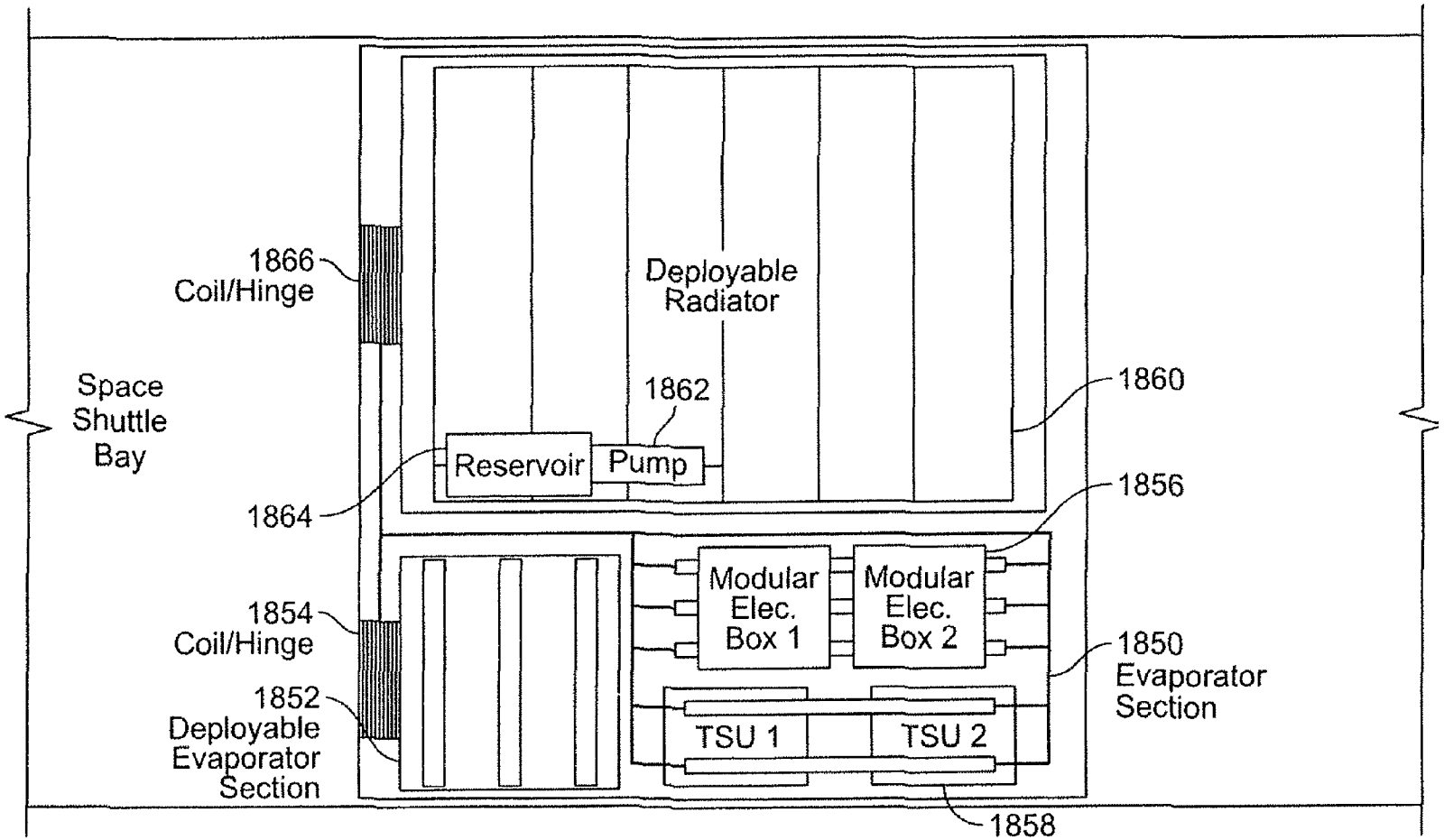

FIGS. 18A-18C illustrate examples of different evaporator and condenser architectures for use with the systems of FIGS. 11-16. As already discussed, such architectures may be characterized by virtually any parallel or series arrangement of evaporators and condensers. In FIG. 18A, a heat flow arrangement involving a centralized thermal bus 1802 is used for defense space applications requiring on-orbit servicing. In this concept, multiple parallel evaporators 1804 are used to cool internal electronics 1806, thermal storage units 1808, on-gimbal evaporator 1810 on a gimbaled payload 1812 that is connected to the bus 1802 by a coil 1814, and on-orbit replaceable electronics modules 1816. Spot coolers 1818 may be used as needed, and the bus 1802 is connected to a deployable or steerable direct condensation radiator 1820 by a coil 1822. The deployable radiator 1820 may include a secondary loop heat pipe evaporator/reservoir mounted on the radiator 1820 to ensure that the radiator 1820 is cold-biased.

In FIG. 18B, an evaporator section 1824 includes multiple cold plates 1826 connected in parallel to a starter pump 1828 and thermal storage units (TSUs) 1830. A two-axis gimbaled cold plate 1832 is also connected to the evaporator section 1824, by way of a coil 1834. The cold plate 1826 may feature equipment mounting locations 1836 having an advanced interface design, as Well as additional spot cooler loops 1838. In this example, a two-axis gimbaled condenser 1840 is connected to the evaporator section 1824 by a coil 1842, and is connected to a pump 1844 and reservoir 1846. Additional cooling may be supplied by a chiller 1848 that is connected to the condenser 1840.

In FIG. 18C, a possible design for use in a space shuttle bay is illustrated, in which an evaporator section 1850 includes a deployable evaporator section 1852 with a coil or hinge 1854, modular electronic boxes 1856, and thermal storage units 1858. A deployable radiator 1860 includes a pump 1862 and reservoir 1864, as well as a coil or hinge 1866.

Figure 19:
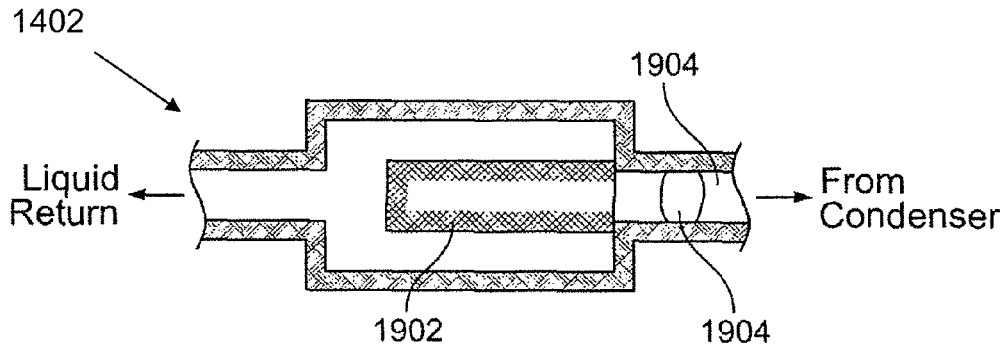
FIG. 19 is a diagram of an example of a condenser flow regulator.

FIG. 19 is a diagram of an example of the condenser flow regulator 1402 of FIGS. 14-16. In FIG. 19, a capillary structure 1902 receives a combined liquid/vapor flow 1904 from an associated condenser, and ensures liquid return to an associated liquid line. As discussed above, the regulator 1402 may thus increase a performance, and reduce a size of, associated parallel condensers.

Figure 20:
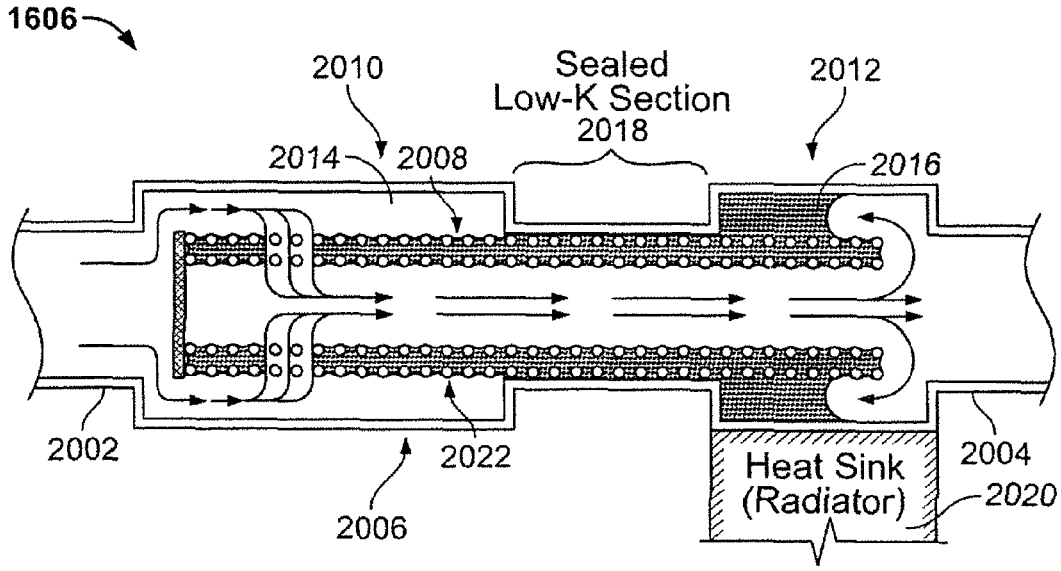
FIG. 20 is a diagram of an example of a back pressure regulator.

FIG. 20 is a diagram of an example of the back pressure regulator (BPR) 1606 of FIG. 16. As discussed above, the BPR 1606 typically is added to a condenser inlet in order to enable heat load sharing in either an active or passive (capillary) pumping mode of a thermal management system, such as the systems of FIGS. 11-16.

In FIG. 20, the BPR 1606 is attached at a vapor transport line 2002 on one end and at a radiator or condenser inlet header 2004 at the other end. The BPR 1606 includes a tubular shell external structure 2006 that has an internal annular wick 2008. The wick 2008 has a first, sealed end 2010 and a second, unsealed (open) end 2012. The sealed end 2010 of the wick 2008 is surrounded by an annular gap 2014 filled with vapor. The unsealed end 2012 of the wick 2008 is surrounded by an annular gap 2016 filled with liquid. As shown, the annular gaps 2014/2016 extend only a portion of the length of the BPR 1606. In a central (low conductance) portion 2018 of the BPR 1606, the tubular shell 2006 makes contact with the wick outer surface, and thereby seals the annular gap 2014 from the annular gap 2016.

Thus, the BPR 1606 typically is positioned at the inlet to the condenser, where the vapor line 2002 meets the condenser inlet header 2004. As such, the unsealed end 2012 of the internal wick 2008 is thermally linked to a cooling source 2020 (e.g., radiator or other heat sink), and is connected to the condenser inlet header 2004 end of the BPR 1606. The other end 2010 (sealed end of the internal wick 2008) is connected in series to the vapor line 2002.

The BPR 1606 ensures that no vapor reaches the condenser unless the vapor space for all evaporators in the system is devoid of liquid. As such, heat load sharing among the many parallel or series evaporators in the system may be increased. The BPR 1606 typically uses pores 2022 selected such that the pore size is larger than the pore size(s) of any of the system evaporators. Thus, as vapor is produced, it is contained within all the evaporator vapor side space, and is thereby given an opportunity to condense. The vapor clears all evaporator vapor side space of liquid and, once that condition is achieved, pushes through the BPR wick 2008 and allows flow to reach the connected condenser.

Figure 21:
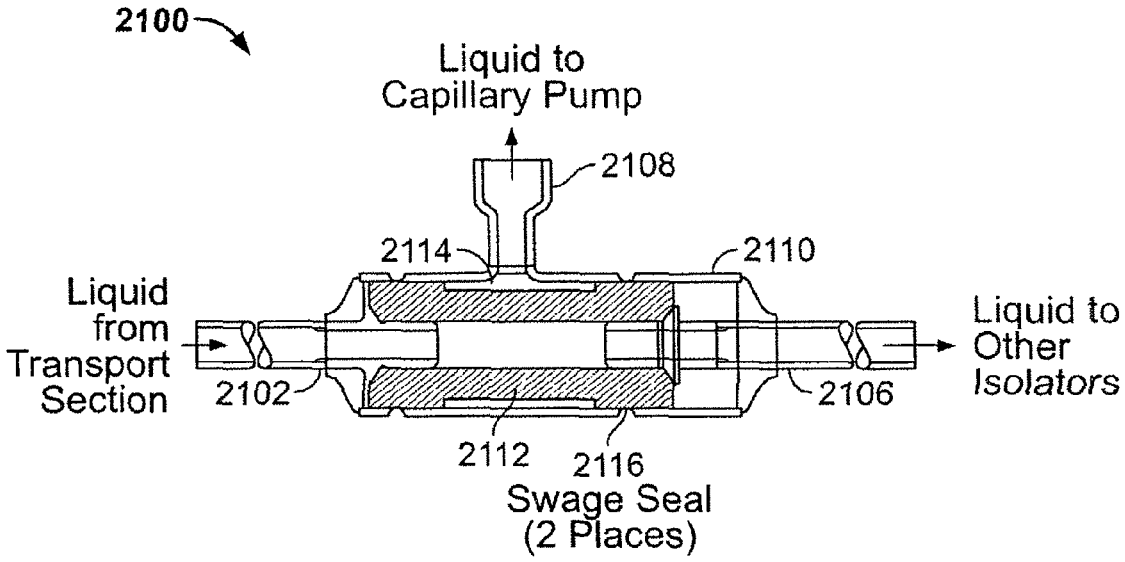
FIGS. 21 and 22 are diagrams of evaporator failure isolators.
Figure 22:
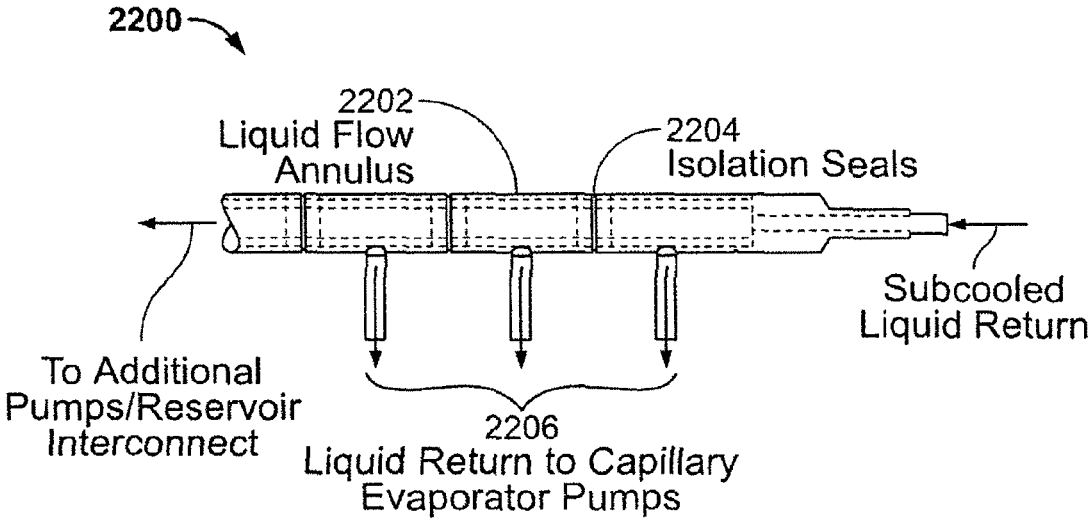

FIGS. 21 and 22 are diagrams of evaporator failure isolators 2100 and 2200, respectively, which may be used in any multi-evaporator implementations of the systems of FIGS. 11-16. The isolators 2100 and 2200 generally are operable to prevent evaporator pump failures at any particular evaporator from propagating throughout an associated thermal management system.

In FIG. 21, the isolator 2100 includes a first port 2102 for receiving liquid flow from a liquid line 2104 supplying liquid to a plurality of evaporators. A liquid return port 2106 outputs liquid to other isolators, and a liquid outlet port 2108 outputs liquid to an associated capillary pump (evaporator).

A tube 2110 defines a body of the isolator 2100 that includes a wick 2112 and a flow annulus 2114. Along with a swage seal 2116, the wick 2112 and flow annulus 2114 enable isolation of the liquid flow to an associated evaporator, through the liquid outlet port 2108. If the associated evaporator experiences pump failure, it may be bypassed by the isolator 2100 until repair may be effected.

Similarly, in FIG. 22, an evaporator failure isolator 2200 includes a liquid flow annulus 2202 through which subcooled liquid flows from an associated reservoir to remaining pumps. Isolation seals 2204 ensure that liquid flow to associated pumps is maintained through ports 2206, such that only currently functioning pumps receive liquid flow.

Figure 23:
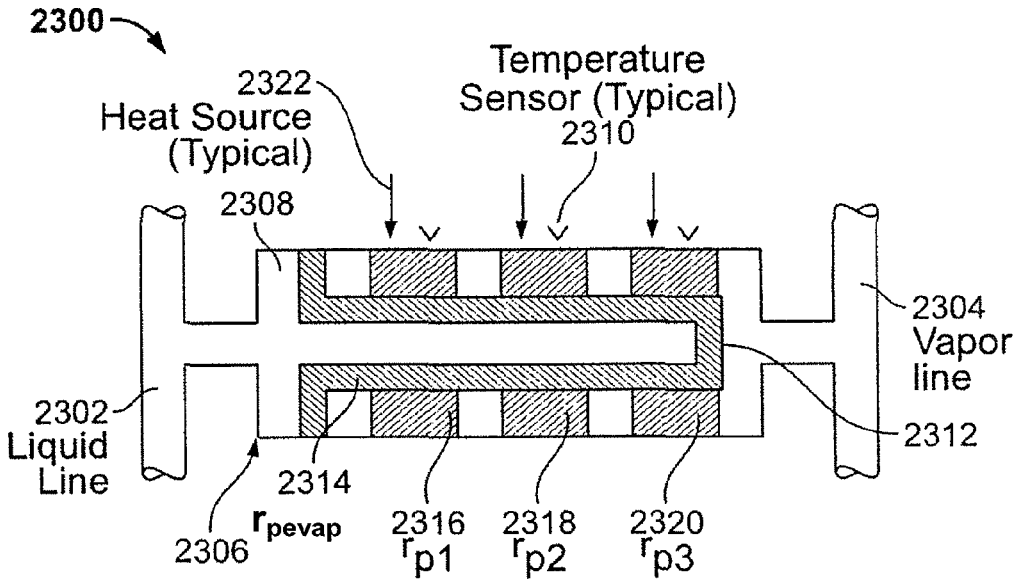
FIGS. 23 and 24 illustrate examples of capillary pressure sensors.
Figure 24:
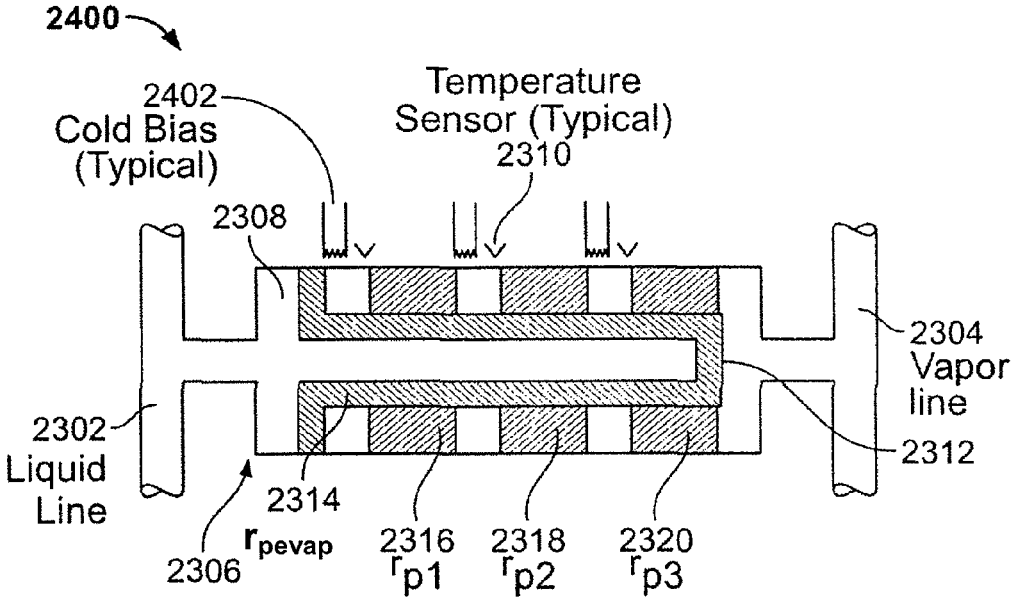

FIGS. 23 and 24 illustrate examples of capillary pressure sensors 2300 and 2400, respectively. Such capillary pressure sensors, generally speaking, provide feedback control for a mechanical pump (e.g., the mechanical pump 1110 of FIG. 11), and enable heat load sharing among multiple evaporators.

In FIGS. 23 and 24, a liquid line 2302 and vapor line 2304 are coupled hydraulically to the capillary pressure sensors 2300 and 2400. Particularly, in FIG. 23, the liquid and vapor lines 2302 and 2304 are adjacent to one or more evaporators, and the capillary pressure sensor 2300 includes a hermetic envelope 2306, an internal wicking structure 2308, and multiple temperature sensors 2310.

The internal wicking structure 2308 includes a continuous wick element 2312 with the same capillary pumping radius 2314 ($r_{pevap}$) as an evaporator wick that hydraulically links the liquid line 2302 to one or more wick segments 2316, 2318, and 2320 with larger capillary pumping radii ($r_{p1}$, $r_{p2}$, and $r_{p3}$). The capillary sensor 2300 is thermally coupled to one or more heat sources 2322.

In operation, the temperature sensors 2310 measure envelope temperature above each wick segment 2316, 2318, 2320, and/or temperature differences between the envelopes above each wick segment 2316, 2318, 2320. Temperature increases on the envelope indicate that the wick segment below the envelope may no longer be saturated with liquid, due to inability of the wick segment to support the pressure difference between the vapor line 2304 and the liquid line 2302. Thus, temperature feedback may be used to adjust a pumping pressure delivered by the mechanical pump 1110 by, for example, adjusting pump speed or adjusting a position of an associated pump bypass valve, in order to maintain saturation of the appropriate wick segment(s).

In FIG. 24, a heat sink 2402 provides cold bias between the wick segments 2316, 2318, and 2320, and multiple temperature sensors 2310 are used to measure temperature in the cold-biased zone(s). The wick segments 2316, 2318, and 2320 may be arranged in sequence, with the wick segment with the largest capillary radius nearest the associated vapor manifold.

In operation, temperature increases on the envelope indicate that the wick segment between the sensor and the vapor manifold may no longer be saturated with liquid due to, for example, an inability of the wick segment to support a pressure difference between the vapor line 2304 and the liquid line 2302. Then, temperature feedback may be used to adjust the pumping pressure delivered by the mechanical pump 1110, by either adjusting pump speed or the position of a pump bypass valve, to maintain saturation of the appropriate wick segment(s).

Figure 25:
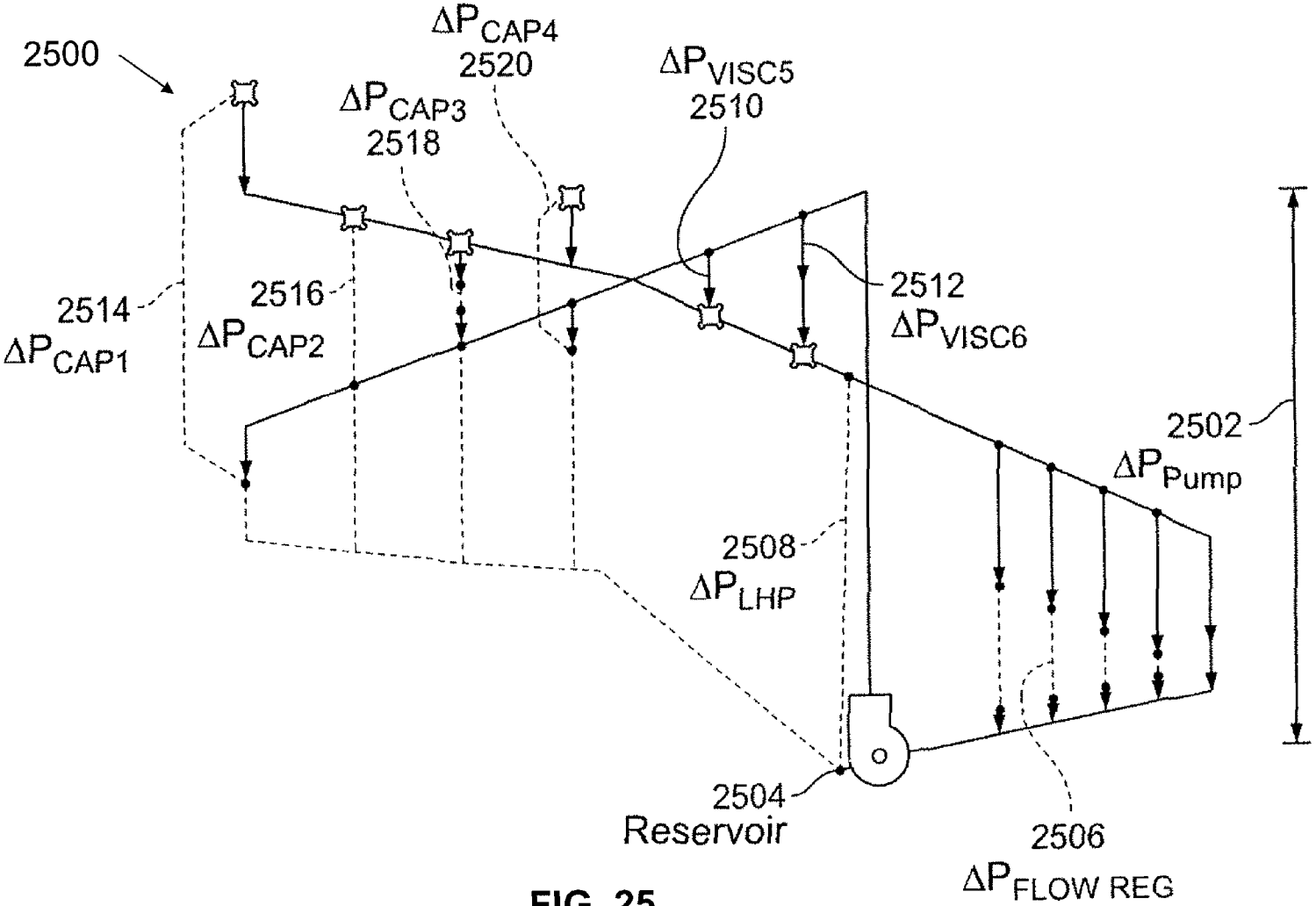
FIG. 25 is a pressure drop diagram for a thermal management system.

FIG. 25 is a pressure drop diagram 2500 for a thermal management system, such as the various implementations of thermal management systems discussed above. In FIG. 25, the mechanical pump 1110 provides a pressure difference $\Delta P_{pump}$ 2502 that is slightly higher than the low pressure point 2504 of the system at the reservoir. Pressure difference $\Delta P_{Flow\ Reg}$ 2506, the pressure differences provided by the flow regulators 1402, are lower than the pressure difference $\Delta P_{LHP}$ 2508 of the Loop Heat Pipe. Other than the pressure differences $\Delta P_{visc\ 5,\ 6}$ 2510, 2512, where a viscous pressure drop may dominate in effect, pressure differentials $\Delta P_{cap\ 1,\ 2,\ 3}$ 2514, 2516, 2518 demonstrate the positive pressure differentials that enable capillary back pressure(s) the evaporators of the thermal management system, using the evaporator wicks, that allow excellent heat transfer and flow control, in conjunction with the mechanical pump 1110. Finally, a pressure difference $\Delta P_{cap\ 4}$ 2520 illustrates a pressure difference maintained for regulating flow through the condenser(s) 1115.

As shown in FIGS. 11-25, many different implementations exist for actively pumped thermal management systems. Such systems include capillary and/or mechanically pumped two-phase thermal management systems that combine the low input power, passive system advantages (e.g., heat load sharing, no moving parts) of small pore wick (capillary) pumped two-phase loop systems with the operational flexibility advantages (e.g., fluid flow-heat flow decoupling and flow controllability) of mechanically pumped two-phase loop systems.

As described, such thermal management systems absorb waste heat from a wide range of sources, including, for example, waste heat of electronics and power conditioning equipment, high-powered spacecraft, antennas, batteries, and laser systems. Military applications, such as space-based radar and lasers, offer a wide suite of potential heat sources and the elements required for their thermal management. Accordingly, such military applications, such as those requiring counterspace detection and offensive force projection capabilities, may benefit from such thermal management systems, which provide high heat transport capability and high heat rejection, as well as high flux heat acquisition and efficient thermal storage, all the while minimizing system mass and maintaining operational reliability over the mission life. Commercial applications, such as, for example, soda-dispensing machines and notebook computers, also may benefit from the implementations of heat transport systems discussed herein, or variations thereof.

What is claimed is:

1. A system comprising:

a condensing system operable to receive vapor from a vapor line, to condense at least some of the vapor, and to output liquid to a liquid line;

a reservoir in fluid communication with the condensing system, wherein the liquid is obtained at least partially from the reservoir;

a primary loop including the condensing system, a first evaporator, the liquid line, and the vapor line, the primary loop being operable to provide a heat transfer path;

a secondary loop including the condensing system, the first evaporator, the liquid line, the vapor line, and an excess fluid line, the secondary loop being operable to provide a venting path for removing other vapor that is present within the liquid from the first evaporator;

wherein, the first evaporator is operable to facilitate heat transfer by evaporating a received liquid to obtain a vapor, the first evaporator including a first port for receiving the liquid from a liquid line, a second port for outputting the vapor to a vapor line, a third port for outputting excess liquid received from the liquid line to an excess fluid line, and a fourth port for outputting the other vapor to a vapor line, such that the vapor line is included within the secondary loop; and a second evaporator connected in parallel with the first evaporator, the second evaporator operable to facilitate heat transfer by evaporating a received liquid to obtain a vapor, the second evaporator including a first port for receiving the liquid from a liquid line, a second port for outputting the vapor to a vapor line, a third port for outputting excess liquid received from the liquid line to an excess fluid line, and a fourth port for outputting the other vapor to a vapor line, such that the vapor line is included within the secondary loop.

2. The system of claim 1, wherein the liquid in the first evaporator and the second evaporator received from the liquid line includes the excess liquid in excess of a liquid amount necessary to maintain saturation of a primary wick within a core of the first evaporator.

3. The system of claim 2, wherein the first evaporator and the second evaporator each includes a secondary wick that is operable to perform phase separation of the other vapor from the liquid for output through the excess fluid line.

4. The system of claim 3, wherein the primary wick and the secondary wick of the first evaporator and the second evaporator maintain capillary pumping of the liquid, the excess liquid, and the vapor, so as to maintain flow control to and through the first evaporator and the second evaporator.

5. The system of claim 1, further comprising a mechanical pump that is operable to facilitate the heat transfer by actively pumping the liquid for evaporation by the first evaporator and the second evaporator, and for output as the excess liquid through the third port to the excess fluid line.

6. The system of claim 5, wherein the reservoir is positioned between an output of the condensing system and an input of the mechanical pump.

7. The system of claim 5, wherein the mechanical pump is positioned between an input of the condensing system and an output of the first evaporator.

8. The system of claim 5, further comprising a bypass valve in parallel with the mechanical pump and operable to bypass the mechanical pump during a passive pumping operation of liquid for evaporation by the first evaporator and the second evaporator.

9. The system of claim 5, wherein the mechanical pump includes a liquid pump that is oriented in series with the liquid line and positioned between the condensing system and the first evaporator and the second evaporator.

10. The system of claim 5, wherein the mechanical pump includes a vapor compressor that is oriented in series with the vapor line and positioned between the first evaporator and the second evaporator and the condensing system.

11. The system of claim 5, further comprising:

a sensor that is operable to communicate a saturation level of a wick of the first evaporator and a wick of the second evaporator to the mechanical pump;

wherein a pumping pressure delivered by the mechanical pump is adjusted, based on the saturation level, so as to maintain saturation of the wick of the first evaporator and the wick of the second evaporator with the liquid.

12. The system of claim 5, further comprising a liquid bypass valve connected between the liquid line and the vapor line and operable to maintain constant pump speed operations of the mechanical pump.

13. The system of claim 5, wherein the first evaporator and the second evaporator each includes a primary wick, the composition of which comprises metal, and a secondary wick, the composition of which comprises metal.

14. The system of claim 1, further comprising a priming system within the secondary loop, the priming system comprising:

a secondary evaporator coupled to the vapor line; and a secondary reservoir in fluid communication with the secondary evaporator and coupled to the first evaporator and the second evaporator by the excess fluid line;

wherein the priming system is operable to provide the liquid to the first evaporator and the second evaporator at least partially from the secondary reservoir.

15. The system of claim 14, wherein the condensing system comprises:

a first condenser within the primary loop coupled to the liquid line and to the vapor line; and a second condenser within the secondary loop coupled to the excess fluid line and to the secondary reservoir.

16. The system of claim 1, wherein the liquid line is coaxial to and contained within the excess fluid line.

17. The system of claim 1, further comprising a back pressure regulator that is oriented in series with the vapor line and positioned between the first evaporator and the second evaporator and the condensing system, and that is operable to substantially equalize a heat load between the first evaporator and the second evaporator.

18. The system of claim 17, wherein the back pressure regulator restricts vapor from reaching the condensing system until a vapor space of the first evaporator and of the second evaporator is substantially devoid of liquid.

19. The system of claim 1, further comprising a third evaporator that is oriented in parallel with the first evaporator and the second evaporator within the primary loop.

20. The system of claim 1, wherein the condensing system comprises a plurality of condensers connected in parallel to one another.

21. The system of claim 20, further comprising:

liquid outputs associated with each of the plurality of condensers and operable to output the liquid to the first evaporator and the second evaporator; and condenser regulators coupled to the liquid outputs and operable to regulate liquid flow therefrom.

22. The system of claim 1, further comprising:

a thermal storage unit coupled to at least one of the first evaporator and the second evaporator.

23. The system of claim 1, further comprising:

first and second flow controllers connected to the first evaporator and the second evaporator, respectively, and operable to regulate liquid flow to the first evaporator and the second evaporator, respectively, so as to ensure a substantially equal heat load distribution between the first evaporator and the second evaporator.

24. The system of claim 1, further comprising:

a condensing heat exchanger coupled to the first evaporator and the second evaporator.

25. The system of claim 24, comprising a spray-cooled evaporator coupled to the condensing heat exchanger by way of a mechanical pump.

26. The system of claim 1, wherein the condensing system comprises a body-mounted radiator.

27. The system of claim 1, wherein the condensing system comprises a deployable or steerable radiator.

28. The system of claim 1, further comprising:

a venting system configured to remove vapor bubbles from a core of the first evaporator and the second evaporator, the venting system including:

a pumping system operable to provide excess liquid to the first evaporator and the second evaporator beyond a saturation amount of liquid needed for saturating a primary wick of the first evaporator and the second evaporator, wherein the reservoir is in fluid communication with the pumping system and provides the excess liquid;

wherein the vapor bubbles are vented from the core of the first evaporator and the second evaporator through the third port of the first evaporator and the second evaporator.

29. The system of claim 28, wherein the pumping system comprises a secondary evaporator in fluid communication with the reservoir and coupled to the vapor line.

30. The system of claim 29, wherein the reservoir is in fluid communication with the secondary wick of the first evaporator and the secondary wick of the second evaporator through a mixed fluid line coupled to the third port of the first evaporator and the third port of the second evaporator.

31. The system of claim 28, wherein the pumping system comprises a mechanical pump.

32. The system of claim 31, wherein the primary wick and the secondary wick of the first evaporator and the primary wick and the secondary wick of the second evaporator maintain capillary pumping of the liquid, the excess liquid, and the vapor, so as to maintain flow control to and through the first evaporator and the second evaporator.

33. The system of claim 28, wherein the excess liquid is substantially removed from the core of the first evaporator and the core of the second evaporator through a fourth port of the first evaporator and the fourth port of the second evaporator.

34. The system of claim 1, wherein the fourth port of the first evaporator comprises a subport of the third port and wherein the fourth port of the first evaporator comprises a subport of the third port.

35. The system of claim 1, wherein the first evaporator includes a core, a primary wick, and a secondary wick, the second evaporator includes a core, a primary wick, a secondary wick, and wherein the first port of the second evaporator is connected in parallel with the first port of the first evaporator, the second port of the second evaporator is connected in parallel with the first port of the first evaporator, the third port of the second evaporator is connected in parallel with the first port of the first evaporator, and the fourth port of the second evaporator is connected in parallel with the first port of the first evaporator.

36. The system of claim 35, wherein the pumping system comprises a mechanical pump.

37. The system of claim 35, wherein the primary wick and the secondary wick of the first evaporator and the primary wick and the secondary wick of the second evaporator maintain capillary pumping of a liquid, the excess liquid, and a vapor, so as to maintain flow control to and through the first evaporator and the second evaporator.

38. The system of claim 35, wherein the pumping system comprises a secondary evaporator in fluid communication with the reservoir and coupled to the vapor line.

39. The system of claim 38, wherein the reservoir is in fluid communication with the secondary wick of the first evaporator and the secondary wick of the second evaporator through a mixed fluid line coupled to the third port of the first evaporator and the third port of the second evaporator.

40. The system of claim 35, wherein the excess liquid is substantially removed from the core of the first evaporator and the core of the second evaporator through a fourth port of the first evaporator and the fourth port of the second evaporator.

* * * * *

UNITED STATES PATENT AND TRADEMARK OFFICE

CERTIFICATE OF CORRECTION

PATENT NO. : 8,066,055 B2
APPLICATION NO. : 12/426001
DATED : November 29, 2011
INVENTOR(S) : Edward J. Kroliczek et al.

It is certified that error appears in the above-identified patent and that said Letters Patent is hereby corrected as shown below:

On the title page:

In ITEM (56) References Cited

OTHER PUBLICATIONS

| | |
|---|---|
| Page 3, 1st column, 1st line of the 4th entry (line 12), | change "Macines" to --Machines-- |
| Page 3, 1st column, 2nd line of the 4th entry (line 13), | change "Refrigeration,"Berchowitz" to --Refrigeration," Berchowitz-- |
| Page 3, 1st column, 3rd line of the 4th entry (line 14), | change "Ozon" to --Ozone-- |
| Page 3, 1st column, 3rd line of the 5th entry (line 18), | change "Reserach," to --Research,-- |
| Page 3, 2nd column, 1st line of the 3rd entry (line 7), | change "Advences" to --Advances-- |
| Page 3, 2nd column, 1st line of the 4th entry (line 10), | change "Advences" to --Advances-- |
| Page 3, 2nd column, 1st line of the 6th entry (line 15), | change "Relable" to --Reliable-- |

Signed and Sealed this
Seventeenth Day of September, 2013

Teresa Stanek Rea
*Deputy Director of the United States Patent and Trademark Office*